US011243500B2

(12) United States Patent
Inoue

(10) Patent No.: US 11,243,500 B2
(45) Date of Patent: Feb. 8, 2022

(54) ELECTRONIC TIMEPIECE, TIME CORRECTION SYSTEM, AND METHOD OF CORRECTING DISPLAY TIME

(71) Applicant: Seiko Epson Corporation, Tokyo (JP)

(72) Inventor: Katsutoyo Inoue, Azumino (JP)

(73) Assignee: Seiko Epson Corporation

( * ) Notice: Subject to any disclaimer, the term of this patent is extended or adjusted under 35 U.S.C. 154(b) by 662 days.

(21) Appl. No.: 16/182,962

(22) Filed: Nov. 7, 2018

(65) Prior Publication Data

US 2019/0137949 A1 May 9, 2019

(30) Foreign Application Priority Data

Nov. 8, 2017 (JP) ..... JP2017-215625

(51) Int. Cl.
*G04R 20/14* (2013.01)

(52) U.S. Cl.
CPC ..... *G04R 20/14* (2013.01)

(58) Field of Classification Search
CPC ..... G04R 20/14; G04R 20/16
See application file for complete search history.

(56) References Cited

U.S. PATENT DOCUMENTS 6,223,050 B1 * 4/2001 Roberts, Jr. ..... H04J 3/0644 368/47
6,282,431 B1 8/2001 Konno
2002/0181333 A1 * 12/2002 Ito ..... G04G 9/0076 368/21
2002/0186619 A1 * 12/2002 Reeves ..... G04G 9/0076 368/47
2003/0067844 A1 * 4/2003 Liaw ..... G04R 20/14 368/47

(Continued)

FOREIGN PATENT DOCUMENTS

EP 3229549 A1 10/2017
JP H03-186792 A 8/1991

(Continued)

OTHER PUBLICATIONS

Extended European Search Report for Patent Application No. EP18204870.2 dated Mar. 19, 2019 (6 pages).

*Primary Examiner* — Daniel P Wicklund
(74) *Attorney, Agent, or Firm* — Harness, Dickey & Pierce, P.L.C.

(57) ABSTRACT

An electronic device and a time correction system acquire time zone-related information through a network and correct the current time at the current location, and reduce power consumption. An electronic timepiece has a time display unit; a communicator that connects to abase station; and a controller. The controller executes a base station information acquisition process of acquiring from the base station base station information unique to the base station, an acquired information evaluation process determining whether or not to acquire time zone-related information based on the base station information, a time zone information acquisition process of acquiring time zone-related information based on the base station information when acquiring time zone-related information is determined in the acquired information evaluation process, and a time correction process of correcting the displayed time based on the acquired time zone-related information.

19 Claims, 27 Drawing Sheets

(56) References Cited

U.S. PATENT DOCUMENTS

2004/0023681 A1* 2/2004 Zschintzsch ..... G04R 20/14 455/550.1
2004/0072595 A1* 4/2004 Anson ..... G04G 9/0076 455/566
2005/0135325 A1* 6/2005 Kang ..... G04R 20/14 370/345
2008/0318557 A1* 12/2008 Poulson ..... H04W 4/06 455/414.1
2009/0088179 A1 4/2009 Stuempert et al.
2009/0271110 A1 10/2009 Sugiura
2010/0135124 A1 6/2010 Hirano
2010/0135178 A1 6/2010 Aggarwal et al.
2011/0151415 A1* 6/2011 Darling ..... G09B 29/005 434/149
2011/0164472 A1 7/2011 Arena
2011/0302443 A1* 12/2011 Lakshminarayanan .. G04G 7/00 713/400
2012/0082173 A1* 4/2012 Fischer ..... G04R 20/06 370/503
2012/0179739 A1* 7/2012 Ji ..... G04G 9/0076 709/201
2013/0007104 A1* 1/2013 Iyer ..... G04G 9/0076 709/203
2013/0165142 A1 6/2013 Huang
2013/0223261 A1 8/2013 Aggarwal et al.
2013/0237246 A1 9/2013 Aggarwal et al.
2014/0192624 A1* 7/2014 Ono ..... G04R 20/00 368/46
2016/0161923 A1* 6/2016 Li ..... G04G 7/00 368/47
2016/0246264 A1 8/2016 Nagareda
2017/0111459 A1* 4/2017 Fisher ..... G04R 20/18
2017/0221321 A1 8/2017 Inoue
2017/0255167 A1* 9/2017 Yamazaki ..... G04G 3/04
2018/0124219 A1* 5/2018 Klopfenstein ..... H04L 69/22
2018/0288093 A1* 10/2018 Kato ..... H04W 4/38
2018/0295409 A1* 10/2018 Takahashi ..... H04L 7/00
2019/0072913 A1* 3/2019 Iwamiya ..... G04R 20/30
2019/0072914 A1* 3/2019 Nagareda ..... G04R 20/00

FOREIGN PATENT DOCUMENTS

JP H10-242269 A 9/1998
JP H11-136755 A 5/1999
JP 2004-003929 A 1/2004
JP 2004-069679 A 3/2004
JP 2006-350887 A 12/2006
JP 2007-085883 A 4/2007
JP 2008-519474 A 6/2008
JP 2009-085605 A 4/2009
JP 2009-264951 A 11/2009
JP 2010-127808 A 6/2010
JP 2014-139568 A 7/2014
JP 2015-053678 A 3/2015
JP 2015-080174 A 4/2015
JP 2016-186490 A 10/2016
JP 2017-133961 A 8/2017
JP 2017-156180 A 9/2017
JP 2017-163184 A 9/2017
WO WO-2017-130912 A1 8/2017
WO WO-2017-154521 A1 9/2017

* cited by examiner

611

| AREA NUMBER | LOCATION INFORMATION (LATITUDE AND LONGITUDE) | TIME DIFFERENCE INFORMATION |
|---|---|---|
| 1 | (N39、E124)、(N31、E146) | +9 |
| 2 | (N49、E108)、(N21、E124) | +8 |
| 3 | (N21、E93)、(N6、E108) | +7 |
| 4 | ・・・ | ・・・ |
| 5 | ・・・ | ・・・ |
| 6 | ・・・ | ・・・ |
| 7 | ・・・ | ・・・ |
| 8 | ・・・ | ・・・ |
| 9 | ・・・ | ・・・ |

FIG. 4

131

| NUMBER | BASE STATION INFORMATION (MAC ADDRESS) | LOCATION INFORMATION |
|---|---|---|
| 1 | 12-AB-3A-F0-48-9E | (N35.68、E139.78) |
| 2 | 54-2C-EF-05-11-45 | (N34.70、E135.49) |
| 3 | 22-24-D3-46-3A-B2 | (N33.59、E130.42) |
| 4 | 34-62-82-44-64-51 | (N43.07、E141.35) |
| 5 | 80-D6-8F-E8-51-67 | (N36.15、E137.95) |
| 6 | 54-15-13-C4-1D-48 | ・・・ |
| 7 | 81-57-E5-AA-8F-54 | ・・・ |
| 8 | AA-85-35-F8-D5-68 | ・・・ |
| 9 | 34-44-56-C4-DF-FF | ・・・ |

FIG. 6

| NUMBER | BASE STATION INFORMATION (MAC ADDRESS) | TIME DIFFERENCE INFORMATION |
|---|---|---|
| 1 | 12-AB-3A-F0-48-9E | +9 |
| 2 | 54-2C-EF-05-11-45 | +9 |
| 3 | 22-24-D3-46-3A-B2 | +9 |
| 4 | 34-62-82-44-64-51 | +9 |
| 5 | 80-D6-8F-E8-51-67 | +9 |
| 6 | 54-15-13-C4-1D-48 | -5 |
| 7 | 81-57-E5-AA-8F-54 | -5 |
| 8 | AA-85-35-F8-D5-68 | -5 |
| 9 | 34-44-56-C4-DF-FF | -5 |

FIG. 11

141

| NORTHWEST CORNER (LATITUDE AND LONGITUDE) | SOUTHEAST CORNER (LATITUDE AND LONGITUDE) | TIME DIFFERENCE INFORMATION | DST START | DST END | DST TIME DIFFERENCE |
|---|---|---|---|---|---|
| N50、E080 | N51、E081 | +6 | NONE | NONE | +0 |
| N50、E000 | N51、E001 | +0 | 01:00 FIRST SUNDAY IN MARCH | 02:00 LAST SUNDAY IN OCTOBER | +1 |
| N50、W080 | N51、W081 | −5 | 02:00 SECOND SUNDAY IN MARCH | 02:00 FIRST SUNDAY IN NOVEMBER | +1 |
| ⋮ | ⋮ | ⋮ | ⋯ | ⋯ | ⋮ |

FIG. 15

151

| NUMBER | BASE STATION INFORMATION (MAC ADDRESS) | TIME DIFFERENCE INFORMATION |
|---|---|---|
| 1 | 12-AB-3A-F0-48-9E | +9 |
| 2 | 54-2C-EF-05-11-45 | +9 |
| 3 | 22-24-D3-46-3A-B2 | +9 |
| 4 | 34-62-82-44-64-51 | +9 |
| 5 | 80-D6-8F-E8-51-67 | +9 |
| 6 | 54-15-13-C4-1D-48 | +2 |
| 7 | 81-57-E5-AA-8F-54 | -10 |
| 8 | AA-85-35-F8-D5-68 | -8 |
| 9 | 34-44-56-C4-DF-FF | -8 |

FIG. 26

ELECTRONIC TIMEPIECE, TIME CORRECTION SYSTEM, AND METHOD OF CORRECTING DISPLAY TIME

BACKGROUND

1. Technical Field

The present invention relates to an electronic timepiece with a timekeeping function for displaying the time at a current location, and to a time correction system.

2. Related Art

JP-A-2007-85883 describes an electronic timepiece that connects through a router to a network, and receives information from other devices (such as an NTP server or time zone database server) connected to the network.

The electronic timepiece described in JP-A-2007-85883 opens a wireless connection with the router, and after an IPv6 address is set, sends that address to the time zone database server. The time zone database server determines whether or not the received address is registered in the time zone table, and if it is, sends area information such as the corresponding time zone identifier (TZID) or the closest NTP server to the electronic timepiece.

Once the area information is received, the electronic timepiece acquires standard time information (such as a network reference time) from the closest NTP server contained in the area information, and corrects the internally kept time to the current local time based on the TZID and reference time.

Each time the electronic timepiece described in JP-A-2007-85883 opens a wireless connection with the router, an IPv6 address is set, and the electronic timepiece automatically communicates with the time zone database server or NTP server. The frequency of communication therefore increases and power consumption increases. As a result, when this technology is applied in a small electronic timepiece such as a wristwatch, battery life drops to as short as one or a few days, a severe loss compared with the typical battery life of one to two years in a typical analog quartz timepiece, which is impractical for an electronic timepiece such as a wristwatch.

Furthermore, even if the electronic timepiece has a rechargeable storage battery, recharging the battery by solar cells typically used in common timepieces is difficult because of the increased power consumption. The electronic timepiece described in JP-A-2007-85883 therefore has a connector for connecting to an external device to recharge the battery with power provided from the external device connected to the connector. As a result, the timepiece must be connected to an external device for charging, and user convenience is poor compared with common electronic timepieces that are charged by solar cells.

SUMMARY

An object of the present invention is to provide an electronic timepiece and time correction system capable of acquiring time zone-related information through a network to correct the current time at the current location, and reducing power consumption.

An electronic device according to the disclosure has a time display unit configured to display time; a communicator configured to connect to a base station; and a controller configured to execute a base station information acquisition process to acquire from the connected base station unique base station information related to the base station, an acquired information evaluation process to determine whether or not to acquire time zone-related information based on the base station information, a time zone information acquisition process to acquire time zone-related information based on the base station information when the acquired information evaluation process determines to acquire time zone-related information, and a time correction process to correct a displayed time based on the acquired time zone-related information.

Because the controller of the electronic device in this aspect of the invention controls the communicator to connect to a base station, the electronic device can connect wirelessly to the Internet or another network. As a result, a mobile electronic device that moves with the user, such as a wristwatch, can connect to different base stations while moving, and can connect to a network after moving.

The controller executes a process of acquiring base station information unique to the connected base station, and based on the acquired base station information can determine whether or not to acquire information related to the time zone. This time zone-related information is information enabling identifying the time zone of the current location, and may be, for example, base station location information (such as the latitude and longitude), or the time zone of the location of the base station (such as the time difference to UTC).

As a result, if the acquired base station information is the same as the latitude acquired base station information, the controller determines the user of the electronic device has stayed in the same time zone. In this case, the controller does not then execute the time zone information acquisition process and time correction process, and can therefore reduce power consumption by the electronic device. However, if the acquired base station information differs from the previously acquired base station information, the controller determines the user may have moved to a different time zone, executes the time zone information acquisition process and time correction process, and can therefore automatically adjust the time appropriately to the time zone of the current location.

Therefore, because the controller can determine whether or not additional processing is required by first acquiring base station information, and only executes additional processes when determined necessary, power consumption can be reduced compared with a configuration that always runs the time zone information acquisition process and time correction process. As a result, battery life can be extended when the electronic device is driven by a primary battery, and can prevent a drop in ease of use in the case of mobile electronic devices such as electronic timepieces. In addition, the electronic device can be driven by a solar cell and storage battery, can be charged without connecting to an external device, and thereby can also prevent a drop in ease of use.

In addition, because the base station information can be acquired when the communicator establishes a connection to the base station, and the power consumption required to acquire base station information is minimal, base station information can be acquired at a 10 minute interval, for example, and base station information can be acquired more frequently. Therefore, when going to a different time zone, the change in time zone can be quickly detected by acquiring information from a different base station, the time zone information acquisition process and time correction process can be quickly executed, the time can be quickly set to appropriately to the time zone of the current location, and user convenience can be improved.

An electronic device according to another aspect of the invention preferably also has storage configured to store previously acquired base station information; and when the base station information acquired through the communicator, and the previously acquired base station information stored in the storage, match in the acquired information evaluation process, the controller determines in the acquired information evaluation process to not acquire time zone-related information.

Because the controller determines to not acquire time zone-related information when the base station information just acquired matches the base station information that was previously acquired, a simple acquired information evaluation process can be executed. For example, if the connected base stations are the same, the probability of being in the same time zone is high even if a low power, long range (from several kilometers to several ten kilometers) communication standard, such as the LPWA network standard, is used for communication between the base station and communicator. Therefore, if the acquired information evaluation process determines if the base station information matches (is the same), a decision can be made easily and appropriately.

Further preferably, an electronic device according to another aspect of the invention also has storage configured to relationally store previously acquired base station information and time difference information; and when the base station information acquired in the base station information acquisition process is included in previously acquired base station information stored in the storage, the controller determines in the acquired information evaluation process to not acquire time zone-related information, and in the time correction process adjusts the displayed time using related time difference information stored in the storage.

The storage relationally stores base station information acquired in the past, and the time difference information that was set when the base station information was acquired.

When base station information that was just acquired is not contained in the base station information that was previously acquired and stored in the storage, the controller executes a time correction process that reads the time difference information corresponding to the base station information from the storage, and adjusts the displayed time using that time difference information, instead of running the process of acquiring the time zone-related information. In the range of the user's daily life, such as the area in which the user moves for commuting to work or school, or shopping, base station information acquired in the past and the time difference information (time zone) set based on the base station information is stored in the storage. As a result, there is no need to re-acquire the time zone-related information, unnecessary communication is eliminated, and power consumption can be reduced.

Further preferably, an electronic device according to another aspect of the invention also has time difference information storage configured to relationally store location information and time difference information; and the controller executes, as the time zone information acquisition process, a location information acquisition process to output the base station information through the base station to a network, and acquire location information of the base station from a location information server connected to the network and storing location information relating the base station information to the base station, and a time difference information acquisition process to acquire from the time difference information storage time difference information corresponding to the acquired location information of the base station; and as the time correction process, corrects the displayed time using the time difference information acquired in the time difference information acquisition process.

Because the electronic device according to this aspect of the invention has time difference information storage, location information corresponding to the base station information can be received directly from the location information server on the network, and there is no need to acquire time difference information corresponding to the location information from the server. As a result, compared with a configuration that acquires time difference information corresponding to the location information from a server, this configuration reduces communication through the Internet, and can reduce the power consumption of the electronic device.

Further preferably in an electronic device according to another aspect of the invention, the controller executes, as the time zone information acquisition process, a location information acquisition process to output the base station information through the base station to a network, and acquire location information of the base station from a location information server on the network and storing location information relating the base station information to the base station, and a time difference information acquisition process outputting the base station location information through the base station to the network, and acquiring time difference information corresponding to the location information from a time zone server connected to the network and storing the location information and time difference information corresponding to the location information; and as the time correction process, corrects the displayed time using the time difference information acquired in the time difference information acquisition process.

Because location information is acquired from a location information server on a network, and time difference information is acquired from a time zone server, the electronic device does not need to have time difference information storage to relationally store location information and time difference information. As a result, the required capacity of the storage in the electronic device can be reduced, and maintenance of the time difference information storage is not necessary.

Furthermore, because the storage capacity of a time zone server on a network is almost unlimited, location information to time difference information relations can be defined in great detail, and the accuracy of the time difference information acquired from the time zone server can be improved.

Further preferably in an electronic device according to another aspect of the invention, the controller executes, as the time zone information acquisition process, a time difference information acquisition process outputting the base station location information through the base station to the network, and acquiring time difference information of the base station from a base station time difference information server connected to the network and storing the base station information and time difference information corresponding to the base station information; and as the time correction process, correcting the displayed time using the time difference information acquired in the time difference information acquisition process.

Because this configuration acquires time difference information directly from the base station information server on the network, the number of servers can be reduced and the installation and operating cost can be reduced compared with a configuration having two servers, a location information server and a time zone server, on the network. Because the electronic device only needs to communicate with the base station information server, the number of communications can be halved compared with two communication processes communicating with two servers, and power consumption can be reduced accordingly.

In addition, because there is no need to provide the electronic device with time difference information storage for relationally storing location information and time difference information, the storage capacity required in the electronic device can be reduced, and maintenance of the time difference information storage is not necessary.

Furthermore, because the base station information server relationally stores base stations to the time difference information at the location of the base station, and can pinpoint the time difference of each base station, the accuracy of the time difference information acquired from the base station information server can be improved.

Further preferably in an electronic device according to another aspect of the invention, the controller, in the time zone information acquisition process, executes the time correction process when the same time difference information is acquired multiple times consecutively.

When the acquired time difference information has changed from the time difference information that is currently set, the electronic device in this aspect of the invention only corrects the time when the new time difference information is consecutively acquired multiple times. As a result, compared with a configuration that corrects the time when new time difference information has been acquired only once, the possibility that the electronic device has moved to a different time zone increases, and the probability of setting the correct time can be improved.

Further preferably in an electronic device according to another aspect of the invention, the controller executes the base station information acquisition process regularly at a first time interval, and if time difference information different from the currently set time difference information is acquired in the time zone information acquisition process, executes the base station information acquisition process at a second time interval that is shorter than the first time interval.

Because the interval until the second and subsequent base station information acquisition processes is shortened by executing the time correction process when time difference information that has changed is acquired multiple times, the time until the time correction process is completed can be shortened. The time between moving to a different time zone and correction of the displayed time is thus shorter, and user convenience can be improved.

Further preferably, an electronic device according to another aspect of the invention also has an operating unit; and the controller selects a condition for correcting the time difference according to operation of the operating unit, and executes the time correction process based on the selected condition.

Because this configuration enables the user to select the conditions for adjusting the displayed time, the user can select a mode in which the displayed time is adjusted when changed (different) time difference information is received only once, and a mode in which the displayed time is adjusted when changed (different) time difference information is received multiple times consecutively. The time correction process can therefore be executed more appropriately.

For example, when the user is riding in a car and moving at high speed, the distance travelled during the time interval between when the time zone information acquisition process executes increases. When the user has moved into a different time zone, the likelihood that the next time zone information acquisition process is executed at a location separated from the previous time zone is therefore high. As a result, even if the displayed time is changed when different time difference information is received once, the displayed time can be quickly changed to the correct time.

However, when the user is walking, the distance travelled during the time interval between when the time zone information acquisition process executes is short. Therefore, when the user has moved into a different time zone, the likelihood that the next time zone information acquisition process is executed is at a location not greatly separated from the previous time zone is high. As a result, the displayed time can more likely be changed to the correct time when the changed (new) time difference information is consecutively received multiple times.

As a result, if the time correction mode can be selected according to user circumstances, the time correction process can be executed more appropriately and user convenience can be improved.

An electronic device according to another aspect of the invention preferably also has an operating unit; and the controller resets the previously set time zone and corrects the displayed time when a previously set operation of the operating unit is executed after the displayed time is corrected based on time zone-related information acquired in the time zone information acquisition process.

When the user has not moved to a different time zone but the displayed time is changed automatically because of connecting to a base station in a different time zone, the user can easily reset the original (previous) time zone by a simple operation. As a result, even if the displayed time is changed against the intent of the user, the previous time can be easily reset, and user convenience can be improved.

Further preferably, an electronic device according to another aspect of the invention also has a generator configured to generate power; and a storage battery that is charged by the generator.

Because an electronic component according this configuration has a power generator and a storage battery, there is no need to connect to an external power supply to charge, and user convenience can be improved. More particularly, because the electronic device acquires time zone-related information when the base station information changes, power consumption is reduced, a storage battery with relatively low capacity can be used, a power generator with a relatively low generating capacity can be used, and the invention can therefore be used in small devices such as wristwatches.

In an electronic device according to another aspect of the invention, the controller regularly executes the base station information acquisition process, and when power is not generated by the generator for a specific time, stops or reduces the execution frequency of the regular base station information acquisition process.

In this configuration, when power is not generated by the generator for a specific time, that is, when the capacity of the storage battery drops, the regular base station information acquisition process stops or the executes at a reduced frequency. Interruption of the communication process due to the power supply from the storage battery dropping can therefore be prevented.

In an electronic device according to another aspect of the invention, the controller regularly executes the base station information acquisition process.

The base station information acquisition process can be initiated by a user operation, but if the process executes regularly, the displayed time can be automatically corrected to the time in the time zone of the current location without involving the user, and user convenience can be improved.

Further preferably in an electronic device according to another aspect of the invention, the communicator can connect to the base station using a Low-Power Wide-Area Network standard.

If the communicator connects to the base station using a low power, wide area wireless communication standard such as LPWA (Low Power Wide Area), power consumption by the electronic device during the communication process can be reduced. The number of base stations can therefore be reduced, and the base station installation cost can be reduced.

Another aspect of the invention is a time correction system comprising multiple base stations connected through a network, a server disposed to the network, and relationally storing unique base station information related to the base stations, and information related to a time zone of the location of the base station, and an electronic device capable of connecting to the base station. The electronic device has a time display unit configured to display time; a communicator configured to connect to a base station; and a controller configured to execute a base station information acquisition process to acquire from the connected base station unique base station information related to the base station, an acquired information evaluation process to determine whether or not to acquire time zone-related information based on the base station information, a time zone information acquisition process to acquire time zone-related information based on the base station information when the acquired information evaluation process determines to acquire time zone-related information, and a time correction process to correct a displayed time based on the acquired time zone-related information; and the server, when the base station information is received from the electronic device, outputs to the electronic device information related to the time zone corresponding to the base station information.

This aspect of the invention has the same effect as the electronic device cove.

Furthermore, the system can be easily constructed by simply installing a server that relationally stores base station information unique to individual base stations, and information related to the time zone of the location where the base station is installed, to an existing network of base stations.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 is a time zone table stored in the time difference information storage of an electronic timepiece according to the first embodiment of the invention.

FIG. 6 illustrates the configuration of a database stored in a positioning information server of the time correction system according to the first embodiment of the invention.

FIG. 11 shows the configuration of the base station information storage of an electronic timepiece according to the second embodiment of the invention.

FIG. 15 shows an example of time zone table stored on the time zone server of a time correction system according to the third embodiment of the invention.

FIG. 26 shows the configuration of a table stored on the base station time difference information server of the time correction system according to the sixth embodiment of the invention.

DESCRIPTION OF EMBODIMENTS

Embodiment 1

A first embodiment of the invention is described below with reference to FIG. 1 to FIG. 9.

The following embodiments include various technically desirable features while describing preferred embodiments of the invention, but the scope of the invention is not limited to the following.

Electronic Timepiece Construction

Figure 1:
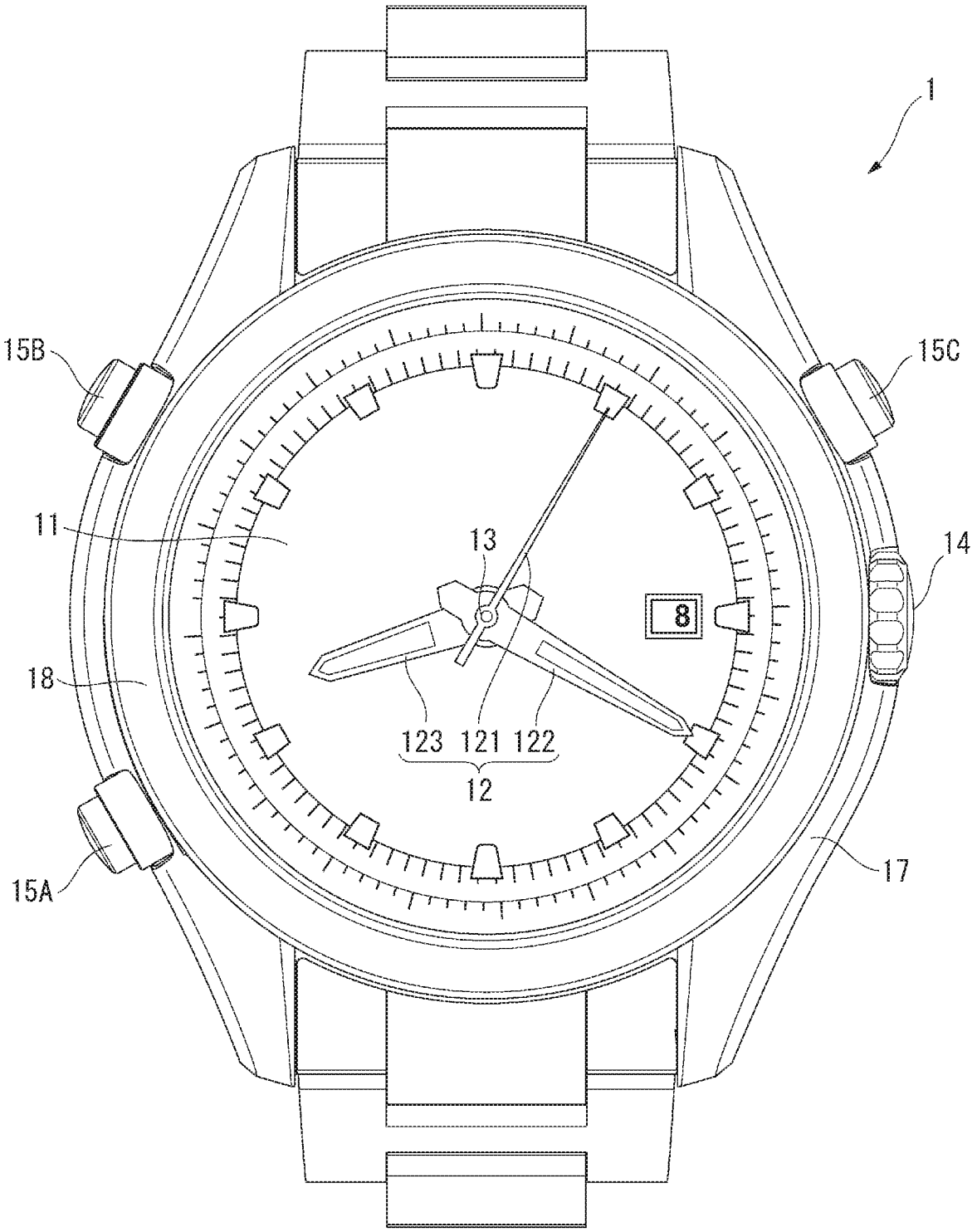
FIG. 1 is a front view an electronic timepiece according to a first embodiment of the invention.
Figure 2:
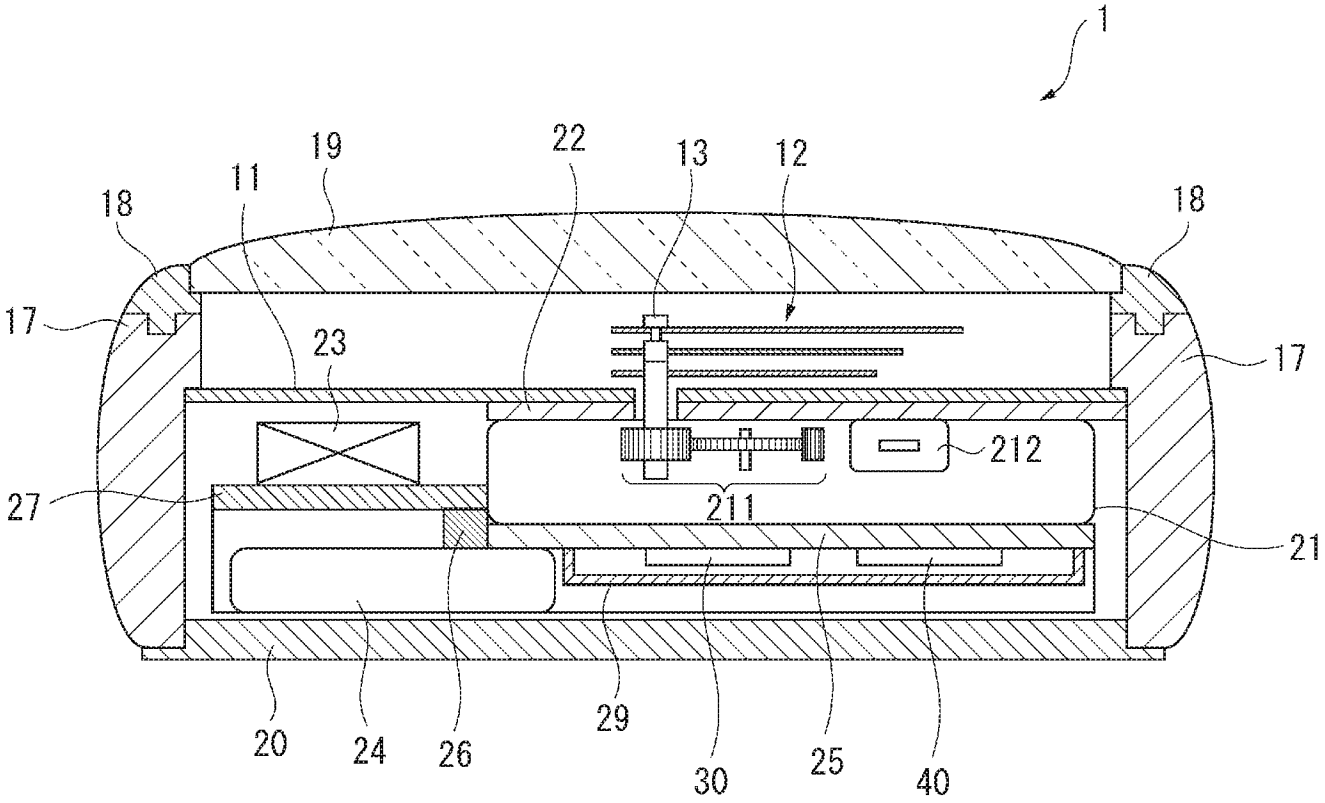
FIG. 2 is a basic section view of an electronic timepiece according to the first embodiment of the invention.

FIG. 1 is a front view an electronic timepiece 1 according to a first embodiment of the invention, and FIG. 2 is a basic section view of the electronic timepiece 1.

As will be understood from FIG. 1, the electronic timepiece 1 is a wristwatch (electronic timepiece) typically worn on the wrist of the user, has a dial 11 and hands 12, keeps time, and shows the time on the face. The greater part of the dial 11 is a non-metallic material (such as plastic or glass) through which light and radio waves easily pass. The hands 12 are disposed on the face side of the dial 11. The hands 12 include a second hand, minute hand, and hour hand that move on a center arbor 13, are driven by a stepper motor through a wheel train 211.

The electronic timepiece 1 also has a crown 14 and buttons 15A, 15B, 15C as operating members.

As shown in FIG. 2, the electronic timepiece 1 has an external case 17 made of stainless steel (SUS), titanium, or other metal. The external case 17 is basically cylindrical. A crystal 19 is attached through a bezel 18 to the opening on the face side of the external case 17. The bezel 18 is made of ceramic or other non-metallic material to improve satellite signal reception performance. A back cover 20 is attached to the opening on the back side of the external case 17. Inside the external case 17 are disposed a movement 21, solar cell 22 as a power generator, antenna 23, and storage battery 24.

The movement 21 includes a stepper motor and wheel train 211. The stepper motor has a motor coil 212, stator and rotor, and drives the hands 12 through the wheel train 211 and center arbor 13.

A circuit board 25 is disposed on the back cover 20 side of the movement 21. The circuit board 25 connects through a connector 26 to an antenna board 27 and the storage battery 24.

Included on the circuit board 25 are a communication circuit 30 for sending and receiving signals with the antenna 23, and a control circuit 40 for controlling operations including driving the stepper motor. The communication circuit 30 and control circuit 40 are covered by a shield 29, and are driven by power supplied from the storage battery 24.

The solar cell 22 is a photovoltaic device for converting light energy to electrical energy. The solar cell 22 has an electrode for outputting the generated power, and is disposed on the back side of the dial 11. Because the greater part of the dial 11 is made from a material through which light passes easily, the solar cell 22 can produce power from light received through the crystal 19 and dial 11.

The storage battery 24 is the power supply of the electronic timepiece 1, and stores power generated by the solar cell 22. Because the storage battery 24 is charged by the solar cell 22, the solar cell 22 in this example embodies a power generator.

The two electrodes of the solar cell 22 and two electrodes of the storage battery 24 can be electrically connected in this electronic timepiece 1, and when connected, the storage battery 24 is charged by the power output of the solar cell 22. This embodiment of the invention uses a lithium ion battery, which is well suited to mobile devices, as the storage battery 24, but a lithium polymer battery or other type of storage battery may be used, an electrical storage device other than a storage battery, such as a capacitor, may be used instead.

The antenna 23 is an antenna for receiving signals according to a low power consumption, wide area wireless telecommunication standard such as LPWA, and is disposed on the antenna board 27 on the back cover 20 side of the dial 11, for example. The part of the dial 11 overlapping the antenna 23 in the direction perpendicular to the dial 11 is made from a material through which radio waves pass easily (such as a non-metallic material with low electrical conductivity and magnetic permeability. The solar cell 22 with electrodes does not intervene between the antenna 23 and dial 11. As a result, the antenna 23 receives a signal passing through the crystal 19 and dial 11.

The communication circuit 30 is a load driven by power stored in the storage battery 24, and sends and receives signals through the antenna 23. The communication circuit 30 supplies the information acquired by radio reception to the control circuit 40. When reception fails, the communication circuit 30 provides that information to the control circuit 40.

Note that the configuration of the communication circuit 30 is the same as an LPWA communication circuit known from the literature, and further description thereof is omitted.

Figure 3:
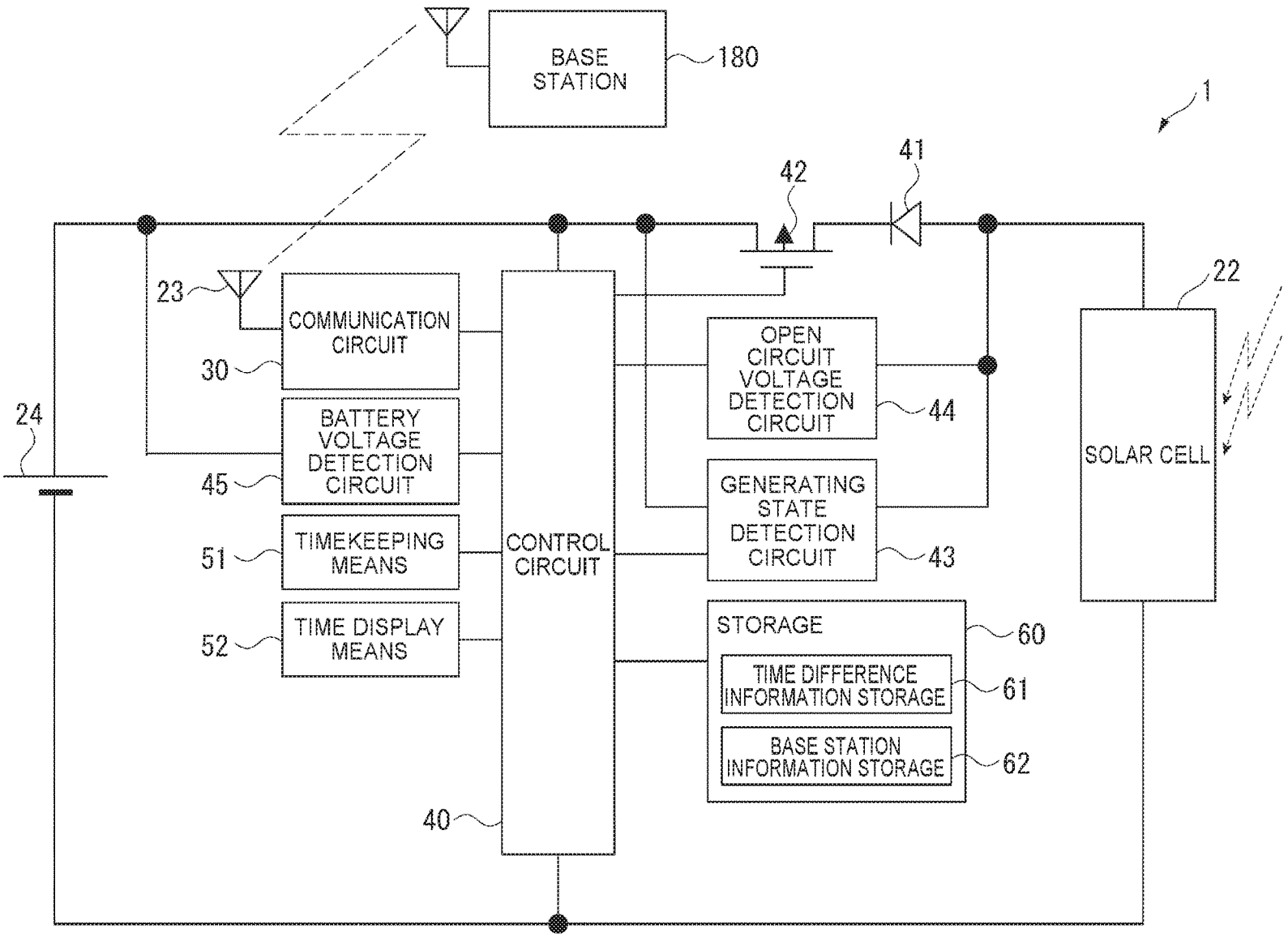
FIG. 3 is a block diagram of the circuit configuration of an electronic timepiece according to the first embodiment of the invention.

FIG. 3 is a block diagram illustrating the circuit configuration of the electronic timepiece 1. As shown in the figure, the electronic timepiece 1 has a solar cell 22 as a power generator, a storage battery 24, an antenna 23, a communication circuit 30, a control circuit 40 as a controller, a diode 41, a charging control switch 42, a generating state detection circuit 43, an open circuit voltage detection circuit 44, a battery voltage detection circuit 45, a timekeeping means 51, a time display means 52 (time display unit), and storage 60. Note that the antenna 23 for LPWA communication and control circuit 40 are an example of a communicator according to the disclosure.

The control circuit 40 is embodied by a CPU for controlling the electronic timepiece 1. As described below, the control circuit 40 controls the communication circuit 30 to execute a communication process. The control circuit 40 stores the remaining level of the storage battery 24 in the storage 60 based on the battery voltage detected by the battery voltage detection circuit 45.

The control circuit 40 also controls the timekeeping means 51 and time display means 52 to execute the timekeeping process and time display process.

The control circuit 40 also controls operation of the charging control switch 42, generating state detection circuit 43, open circuit voltage detection circuit 44, and battery voltage detection circuit 45.

The diode 41 is disposed on a path electrically connecting the solar cell 22 and storage battery 24, and interrupts the current supply from the storage battery 24 to the solar cell 22 (reverse current) without interrupting the current supply from the solar cell 22 to the storage battery 24 (forward current). Note that forward current flow is limited to when the voltage of the solar cell 22 is greater than the voltage of the storage battery 24, that is, when charging. When the voltage of the solar cell 22 is lower than the voltage of the storage battery 24, the diode 41 prevents current from flowing from the storage battery 24 to the solar cell 22. Note that a field-effect transistor (FET) may be used instead of the diode 41.

The charging control switch 42 opens and closes the current path from the solar cell 22 to the storage battery 24, and includes a switching device disposed on the path electrically connecting the solar cell 22 and storage battery 24. The switching device in this example is a p-channel transistor, is ON when the gate voltage is low, and is OFF when the gate voltage is high. The control circuit 40 controls the gate voltage.

When the switching device goes from OFF to ON, the charging control switch 42 turns on (closes), and when the switching device goes from ON to OF, the charging control switch 42 turns off (opens).

The charging control switch 42 turns off when the battery voltage of the storage battery 24 is greater than or equal to a specific value to that battery performance does not deteriorate due to overcharging. As a result, the charging control switch 42 functions as a limit switch that prevents overcharging.

The generating state detection circuit 43 operates based on a control signal specifying the generating state (charging state) detecting timing, detects the charging state from the solar cell 22 to the storage battery 24, and outputs the detection result to the control circuit 40.

The detection result indicates either generating (charging) or not-generating (not charging). The detection result is based on the battery voltage VCC and the PVIN of the solar cell 22 when the charging control switch 42 is on. For example, if the voltage drop of the diode 41 is Vth, and the on resistance of the switching device is ignored, the solar cell 22 is determined to be charging if PVIN−Vth>VCC, and not-charging if PVIN−Vth<=VCC.

The control signal in this embodiment of the invention is a pulse signal with a 1 second period, and the generating state detection circuit 43 detects the charging state while the control signal is high. In other words, the generating state detection circuit 43 repeatedly detects the charging state at a 1-second interval while the charging control switch 42 is closed.

Note that the charging state is detected intermittently to reduce the power consumption of the generating state detection circuit 43. If such reduction is not necessary, the charging state maybe detected continuously. The generating state detection circuit 43 may also be configured using a comparator or A/D converter, for example.

The open circuit voltage detection circuit 44 operates based on a control signal that specifies the voltage detection timing, and based on this control signal detects the terminal voltage PVIN of the solar cell 22, that is, the open circuit voltage of the solar cell 22, when the charging control switch 42 is off. The open circuit voltage detection circuit 44 outputs the detection result of the open circuit voltage to the control circuit 40.

The battery voltage detection circuit 45 measures the battery voltage VCC of the storage battery 24.

The timekeeping means 51 includes reference signal source such as a crystal oscillator that outputs a reference signal, a first counter that counts the reference signal and keeps Coordinated Universal Time (UTC), nonvolatile memory that stores the time difference information to UTC, and a second counter that keeps the local reference time in the current location based on the output value (UTC) of the first counter and the time difference information.

When time information is received by the communication circuit 30, the timekeeping means 51 updates the first counter and corrects the time based on the received time information. In this embodiment of the invention the timekeeping means 51 counts UTC. As a result, if the received time information is UTC, the first counter is updated to UTC, but if time information other than UTC (such as JST (Japan Standard Time)) is received, the received time is converted to UTC and the first counter then updated.

The time display means 52 also has a movement 21 that is driven by power stored in the storage battery 24, and moves the hands 12 to indicate the time kept by the timekeeping means 51 (the second counter time).

Note that when a server that outputs JST (Japan Standard Time) is specified as the time server 120 described below, the first counter of the timekeeping means 51 is updated according to JST, and if the time difference to UTC is acquired as the information related to the time zone, the received information may be converted to the time difference to JST, stored in nonvolatile memory, and the second counter updated.

As shown in FIG. 3, the storage 60 includes time difference information storage 61 and base station information storage 62.

The time difference information storage 61 is nonvolatile memory such as EEPROM or flash memory, and as shown in FIG. 4, stores a time zone table (time zone database) 611 relating positioning information (latitude and longitude) to the time difference to UTC.

When map data is divided into rectangular regions, the positioning information in the time zone table 611 stores the latitude and longitude for two diametrically opposite corners of each rectangular region. For example, the positioning data of the location at the top left corner (northwest corner) of region 1 in FIG. 4 is 39 degrees north latitude, 124 degrees east longitude, the positioning data for the location at the bottom right corner (southeast corner) is 31 degrees north latitude, 146 degrees east longitude, and the time difference of this region to UTC is +9 hours.

Therefore, when positioning information (latitude and longitude) for the connected base station 180 is acquired, the control circuit 40 can read the time difference information (time zone) corresponding to the related latitude and longitude data from the time zone table 611 in the time difference information storage 61. Note that if daylight saving time (DST) is used in the time zone, DST information is also recorded in the time zone table 611, and the control circuit 40 may determine whether or not daylight saving time is in effect and read the time difference information based on the date and time kept by the timekeeping means 51.

The base station information storage 62 is nonvolatile memory, like the time difference information storage 61, and stores a unique serial number for previously stored base stations, and more specifically stores the MAC address.

Time correction system configuration

Figure 5:
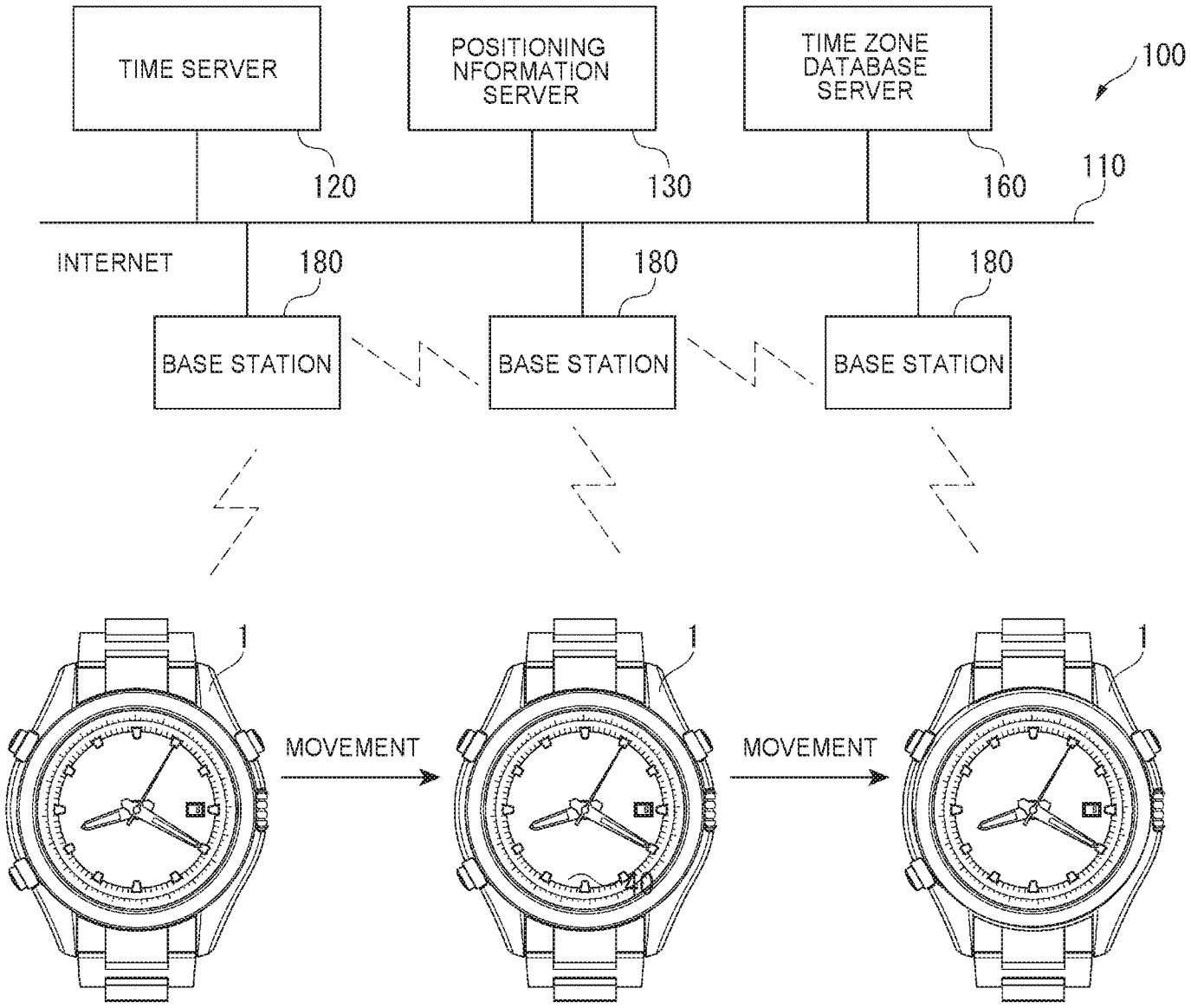
FIG. 5 illustrates the configuration of a time correction system according to the first embodiment of the invention.

The time correction system 100 that corrects the time kept by the electronic timepiece 1 is described next with reference to FIG. 5.

The time correction system 100 includes a time server 120, positioning information server 130, time zone database server 160, multiple base stations 180 (gateways GW), and an electronic timepiece 1. The time server 120, positioning information server 130, time zone database server 160, and base stations 180 are each connected to the Internet 110.

The time server 120 is a server, such as an NTP (Network Time Protocol) server, that transmits time information. Note that a NTP server normally transmits UTC, but may transmit the standard time in the country where the NTP server is located. As a result, when acquiring time information, the connected NTP server is already known, and the control circuit 40 of the electronic timepiece 1 knows whether the acquired time information is UTC or is the standard time in a specific country (such as JST (Japan Standard Time)). When time information other than UTC is acquired, the control circuit 40 converts the acquired time information to UTC. The control circuit 40 then updates the first counter of the timekeeping means 51 based on the converted UTC time information as described above.

As shown in FIG. 6, the positioning information server 130 stores a database 131 relationally storing information unique to each base station 180 (referred to below as base station information), and positioning information (latitude and longitude) for each base station 180. When positioning information is queried based on the base station information, the positioning information server 130 references the database 131 to return the positioning information.

The base station information is, more specifically, the MAC address. The positioning information also stores the latitude and longitude in decimal notation. For example, the positioning information of number 1 in FIG. 6 is north latitude 35.68 (35 degree 40 minutes 48 seconds), east longitude 139.78 (139 degrees 46 minutes 48 second).

The time zone database server 160 is disposed for updating the time zone table 611 stored in the time difference information storage 61 of the electronic timepiece 1. The process of updating the time zone table 611 based on the time zone database server 160 is described below.

The base station 180 communicates wirelessly with the electronic timepiece 1, and functions as a gateway for connecting the electronic timepiece 1 to the Internet 110 (network). The electronic timepiece 1 and base station 180 are capable of communicating several bytes to several ten bytes for requesting and receiving time data, current location, and time difference information. As a result, the communication speed between the base station 180 and communication circuit 30 is slow, as in a LPWA network, but power consumption is reduced by using a low power consumption communication method.

The base station 180 is disposed according to the type of LPWA network, and each base station 180 has a unique MAC address for connecting to the Internet 110.

Control Circuit Operation

Operation of the control circuit 40 of the electronic timepiece 1 is described below with reference to the flow charts in FIG. 7 and FIG. 8.

Time Zone Checking Process

Figure 7:
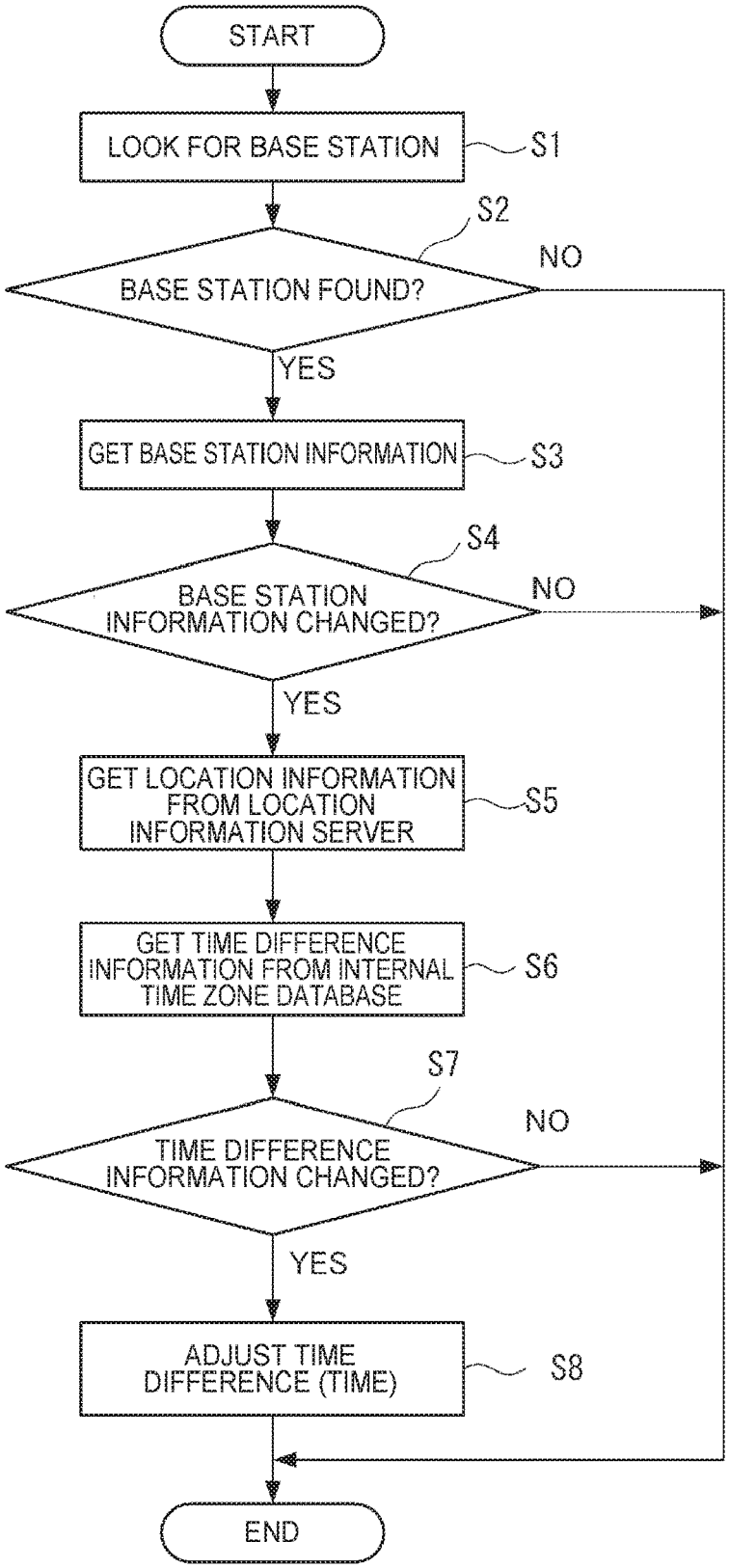
FIG. 7 is a flow chart of the time zone checking process of an electronic timepiece according to the first embodiment of the invention.

The control circuit 40 executes the time zone checking process shown in FIG. 7 for confirming the time zone in the current location at a previously set first time interval. The first time interval is, for example, 10 minutes, but may be set based on the balance between the capacity of the storage battery 24 and power consumption in the time zone checking process, or the allowable time lag to correcting the displayed time when the time zone changes.

In the time zone checking process, the control circuit 40 executes a base station information acquisition process, acquired information evaluation process, time zone information acquisition process, and time correction process.

Base Station Information Acquisition Process

When the control circuit 40 runs the time zone checking process shown in FIG. 7, it first checks for the presence of a base station 180 (step S1). More specifically, the control circuit 40 uplinks to the base station 180 through the communication circuit 30.

Next, the control circuit 40 determines whether or not there is a base station 180 based on whether or not there is a downlink from the base station 180 in response to the uplink (step S2).

If there is a base station 180, the control circuit 40 returns YES in step S2, and then acquires the base station information, or more specifically the MAC address, through the communication circuit 30 (step S3).

Acquired Information Evaluation Process

The control circuit 40 compares the acquired base station information (MAC address) with the previously acquired base station information (MAC address) stored in the base station information storage 62 of the storage 60, and determines if there is a difference (step S4).

Time Zone Information Acquisition Process

If the base station changes and YES is returned in step S4, the control circuit 40 executes a positioning information acquisition process of outputting the acquired base station information to the positioning information server 130 on the Internet 110, and acquiring the location information (latitude and longitude) corresponding to the base station information from the positioning information server 130 as the information related to the time zone (referred to below as time zone-related information) (step S5).

Next, the control circuit 40 executes a time difference information acquisition process of acquiring from the time difference information storage 61 time difference information corresponding to the location information (latitude and longitude) acquired in step S5 (step S6). For example, if the location information acquired in step S5 was north latitude 35.68, east longitude 139.78 (number 1 in FIG. 6), this location information is included in region 1 in the time difference information storage 61 in FIG. 4, and the control circuit 40 acquires information the time difference is +9 hours.

Time Correction Process

The control circuit 40 then determines if the time difference information acquired in step S6 is different from the time difference information currently set in the timekeeping means 51 (step S7).

If the control circuit 40 determines in step S7 that the time difference information changed, it updates the time difference information set in the timekeeping means 51 to the acquired time difference information. As a result, the second counter that keeps the standard time at the current location is corrected in the timekeeping means 51. The control circuit 40 then controls the time display means 52 to adjust the time indicated by the hands 12 according to the corrected time information of the second counter (step S8).

Ending the Time Zone Checking Process

When the time difference, that is, the time, is corrected in step S8, the control circuit 40 ends the time zone checking process shown in FIG. 7.

If there is no base station 180 and step S2 returns NO, or the acquired base station information has not changed and step S4 returns NO, or the acquired time difference information has not changed and step S7 returns NO, the time zone checking process ends without correcting the time difference (time) in step S8.

Internal Time Correction Process

Figure 8:
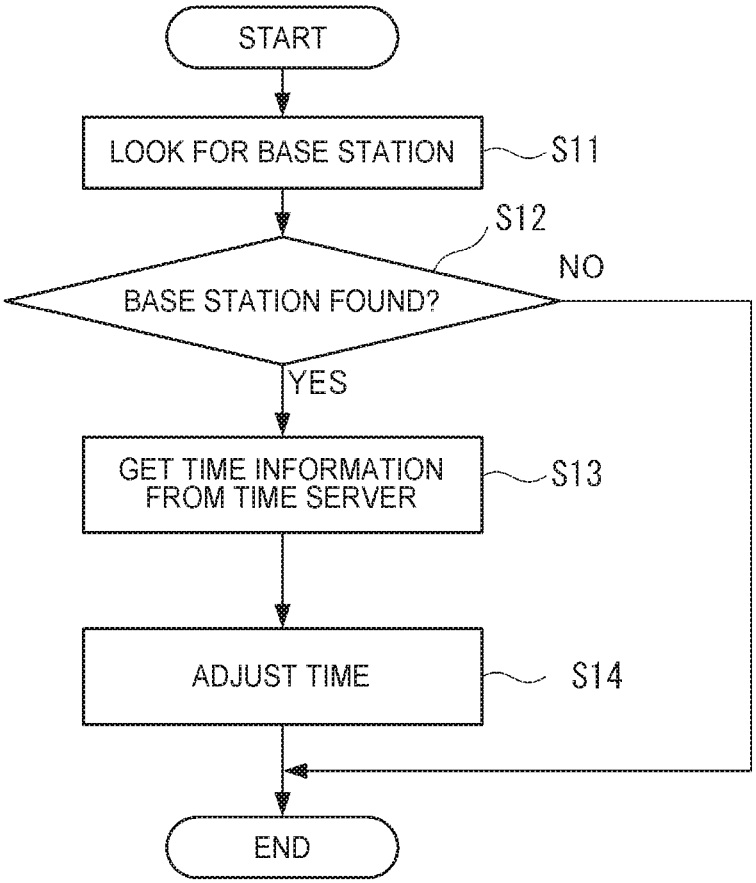
FIG. 8 is a flow chart of the internal time correction process of an electronic timepiece according to the first embodiment of the invention.

The control circuit 40 executes the internal time correction process shown in FIG. 8 at a previously set time interval (such as 24 hours). The internal time correction process executes every 24 hours because the internal time precision of a timekeeping means 51 using a reference signal source such as a crystal oscillator is normally less than one second per day, and the accuracy of the displayed time can be maintained by executing the internal time correction process once a day.

When the control circuit 40 runs the internal time correction process shown in FIG. 8, as in steps S1 and S2 in FIG. 7 it first checks for a base station 180 (step S11), and determines if a base station 180 was found (step S12).

If there is a base station 180 and step S12 returns YES, the control circuit 40 acquires time information from the time server 120 on the Internet 110 (step S13). Note that because the time server 120 to connect to is already identified, the control circuit 40 knows if the acquired time information is UTC or the standard time in the identified region, and if a local standard time other than UTC is acquired, converted the acquired time to UTC. The control circuit 40 therefore updates the first counter of the timekeeping means 51 to the time (UTC) acquired from the time server 120. As a result, the second counter that keeps the standard time in the current location in the timekeeping means 51 is also corrected. The control circuit 40 then controls the time display means 52 to adjust the time indicated by the hands 12 according to the corrected time information of the second counter (step S14).

The specific process of acquiring the time from a time server 120 and updating the internal time may be a common method using the NTP (Network Time Protocol). As a result, even if the communication speed of the communication method used is slow, as in a LPWA network, the delay due to the communication time can be corrected to set the accurate time.

Time Zone Table Updating Process

The process of updating the time zone table 611 when the time zone changes in a particular region will be described next.

The time zone of a particular region or country may be changed as desired by the government that sets the time zone in that region. When daylight saving time starts and ends may also change as desired. When this happens, the time zone table 611 stored in the time difference information storage 61 of the electronic timepiece 1 must be updated. The process of updating the time zone table 611 is described next with reference to FIG. 9.

Update Process on the Time Zone Database Server

The time zone database (time zone table) stored on the time zone database server 160 is managed by the administrator of the time zone database server 160, and when a change in the time zone information is decided, the administrator updates the time zone database stored on the time zone database server 160 before the date when application of the new time zone starts. Normally, the updated time zone database is registered a specific time before application of the new time zone starts (such as one month before, and both the current time zone database and data for updating the time zone database are stored on the time zone database server 160.

Time zone database update information is sent from the time zone database server 160 administrator to each electronic timepiece 1 user by mail, for example. The user may also learn of the update through the news, for example.

Update Process on the Electronic Timepiece

Figure 9:
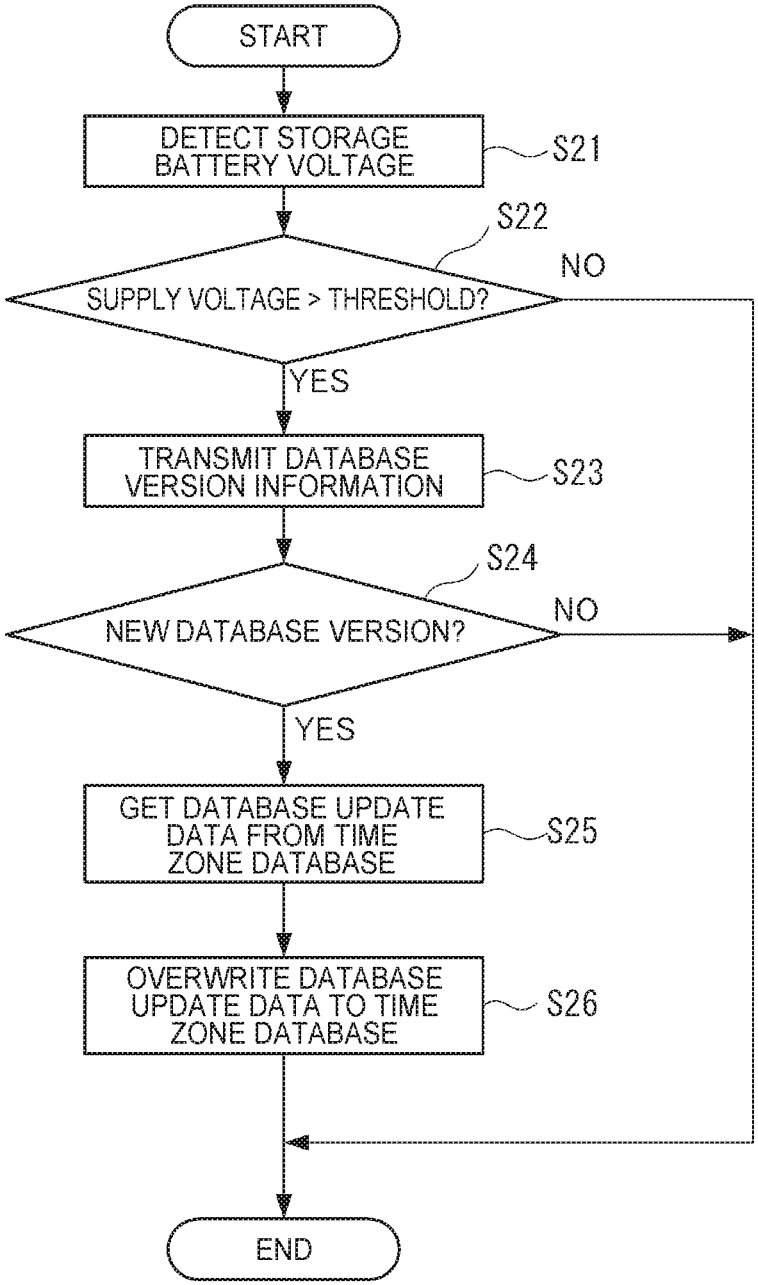
FIG. 9 is a flow chart of the time zone table updating process of an electronic timepiece according to the first embodiment of the invention.

When the user knows the time zone database will be updated and presses a specific button (such as button 15C in this example) of the electronic timepiece 1, the control circuit 40 of the electronic timepiece 1 executes the time zone table 611 update process as shown in FIG. 9.

When the update process starts, the control circuit 40 first detects the voltage of the storage battery 24 (step S21), and determines if the detected voltage of the storage battery 24 (power supply voltage) is greater than a specific threshold (step S22).

More specifically, if the voltage of the storage battery 24 drops while receiving the database update data for the time zone table 611 or while writing to the time difference information storage 61, the reception process or writing process may fail. As a result, the control circuit 40 checks the storage battery 24 voltage (supply voltage) before starting the update process, and determines if the battery voltage (remaining battery capacity) is a voltage level sufficient to complete the update process.

If control circuit 40 determines NO in step S22, it aborts the update process. Note that the control circuit 40 may move the hands 12, for example, to a specific position indicating that the supply voltage is low. In this event, the user knows that the storage battery 24 voltage is low, expose the solar cell 22 of the electronic timepiece 1 to sunlight or a light to charge the storage battery 24, and then press the button 15C again to execute the update process after charging the storage battery 24.

If the control circuit 40 determines that the voltage of the storage battery 24 exceeds the threshold and returns YES in step S22, the control circuit 40 sends version information (database version information) for the time zone table 611 currently stored in the time difference information storage 61 through the base station 180 to the time zone database server 160 (step S23).

The time zone database server 160 then references the database version information that was sent, and notifies the electronic timepiece 1 whether or not there is a new version. As a result, the control circuit 40 can determine based on the information received from the time zone database server 160 whether or not there is a new version (step S24), and ends the update process if a new version is not available and step S24 returns NO.

If there is a new version and YES is returned in step S24, the control circuit 40 receives and acquires the database update data from the time zone database server 160 (step S25).

Next, using the acquired database update data, the control circuit 40 updates the time zone table 611 in the time difference information storage 61 (step S26).

Note that to minimize the size of the update data to enable communication over a LPWA network, the database update data preferably contains only the time zone data that changed. The control circuit 40 can therefore update only the data that changed in the time zone table 611 of the time difference information storage 61 based on the database update data.

Note that while the amount of data to communicate increases, the entire time zone database including the changed parts maybe sent from the time zone database server 160 to the electronic timepiece 1 to completely overwrite the time zone table 611 in the time difference information storage 61.

Effect of Embodiment 1

When the acquired base station information is the same as the last base station information in this first embodiment, the control circuit 40 of the electronic timepiece 1 determines the electronic timepiece 1 is still in the same time zone, and does not run the time zone information acquisition process and time correction process, and can thereby reduce the power consumption of the electronic timepiece 1. In addition, when the acquired base station information is different from the previously acquired information, that is, when the electronic timepiece 1 may have moved to a different time zone, the control circuit 40 executes the time zone information acquisition process and time correction process. As a result, the time displayed by the electronic timepiece 1 can be automatically corrected to the time in the time zone of the current location.

As a result, because the displayed time can be automatically corrected when moving to a different time zone, and the average power consumption can be reduced, the invention can be applied in a wristwatch driven by a solar cell 22, and user convenience can be improved.

Furthermore, because the base station information can be acquired when the communication circuit 30 opens a communication connection to a base station 180, and very little power is required to acquire the base station information, base station information can be acquired at a ten minute interval, for example. As a result, when the electronic timepiece 1 moves to a different time zone, the time can be automatically corrected according to the time zone of the current location in approximately ten minutes, and user convenience can be improved.

Furthermore, because communication between the base station 180 and communication circuit 30 uses an LPWA network, power consumption can be further reduced during the electronic timepiece 1 communication process. In addition, because the base stations 180 can be located relatively far apart and the number of base stations 180 can therefore be reduced, the installation and operating costs of the base stations 180 can be reduced.

Because the electronic timepiece 1 also has a time difference information storage 61 storing a time zone table 611 relating positioning information to time difference information, electronic timepiece 1 also does not need to acquire time difference information from a server. As a result, communication through a base station 180 is only required when acquiring positioning information from the positioning information server 130, the number of times communication through the base station 180 is required can be reduced, and power consumption during the communication process can be further reduced.

In addition, because the time correction system includes a time zone database server 160, the process for updating the time zone table 611 can be simplified.

Embodiment 2

A second embodiment of the invention is described next with reference to FIG. 10 to FIG. 12.

Figure 10:
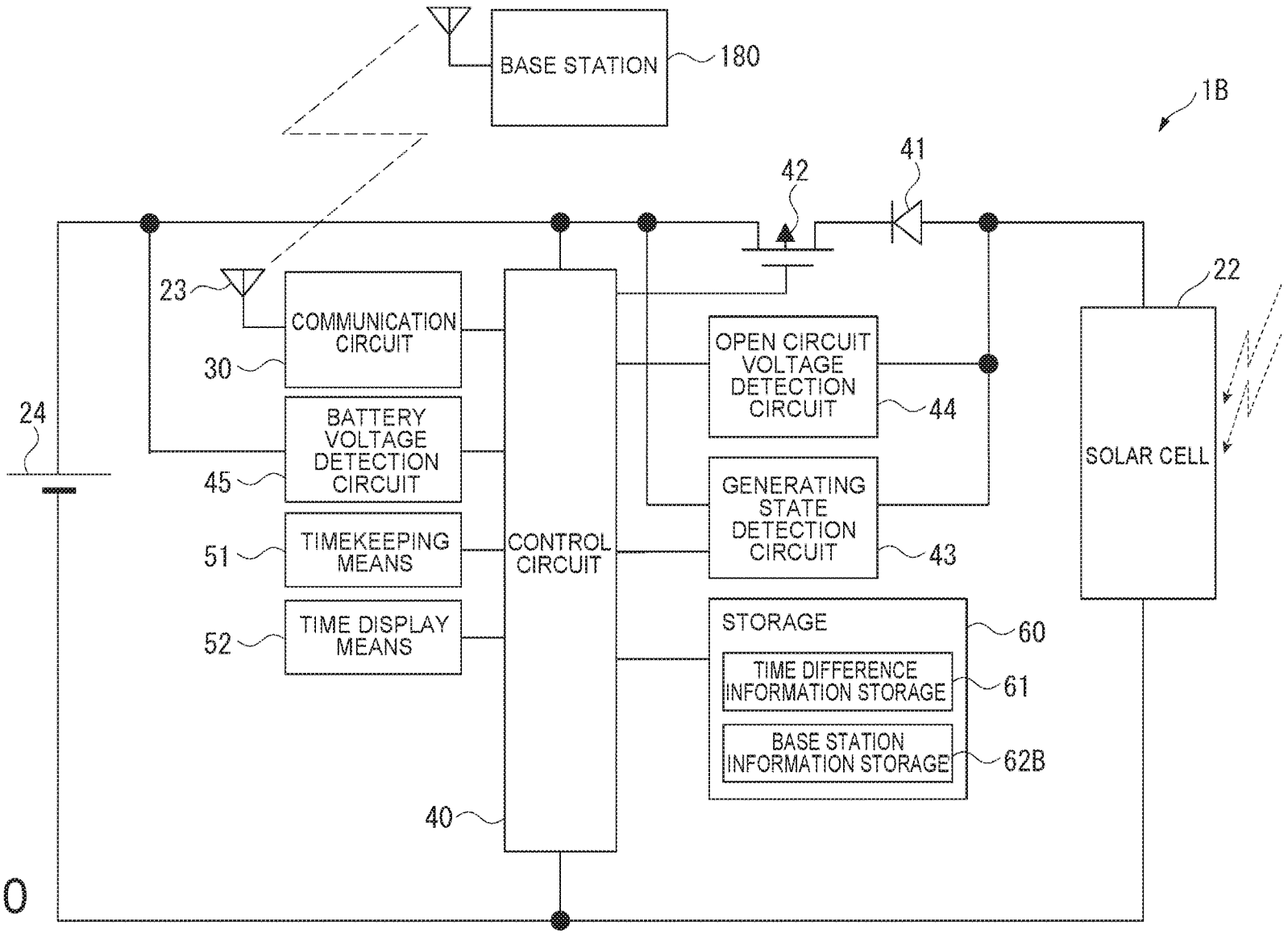
FIG. 10 is a block diagram of the circuit configuration of an electronic timepiece according to a second embodiment of the invention.

As shown in FIG. 10, an electronic timepiece 1B according to the second embodiment of the invention is configured identically to the electronic timepiece 1 of the first embodiment, but differs in the base station information storage 62B stored in the storage 60, and the time zone checking process therefore also differs in part. Note that the configuration on the network side of the time correction system according to the second embodiment of the invention is the same as in the first embodiment, and further description thereof is therefore omitted.

The base station information storage 62 in the first embodiment stores the previously acquired base station information. As shown in FIG. 11, however, the base station information storage 62B according to the second embodiment of the invention relationally stores the previously acquired base station information (MAC addresses) and corresponding time difference information (difference to UTC).

FIG. 11 shows some of the base station information stored in the base station information storage 62B, but in the second embodiment can store the 100 most recently received sets of base station information. Note that the number of base station information entries stored in the base station information storage 62B may be set according to the storage capacity of the storage 60, for example.

Note also that if the maximum number (100) of base station information entries is already stored in the base station information storage 62B, and new base station information that is not stored in the base station information storage 62B is received, the new base station information may be added by deleting the oldest base station information entry in the base station information storage 62B.

In addition, time difference information acquired from the time difference information storage 61 using geographical information (latitude and longitude) acquired from the positioning information server 130 based on the base station information is stored in the time difference information in the base station information storage 62B. In this case, two time differences may be stored in the time difference information in the base station information storage 62B for time zones which include a period of daylight saving time (DST), and the appropriate time difference selected based on the current date.

Next, the time zone checking process of the electronic timepiece 1B according to the second embodiment of the invention is described further below with reference to the flow chart in FIG. 12. Note that the same steps in the flow chart in FIG. 12 and the time zone checking process of the first embodiment shown in FIG. 7 are identified by the same reference numerals, and further description thereof is omitted.

Figure 12:
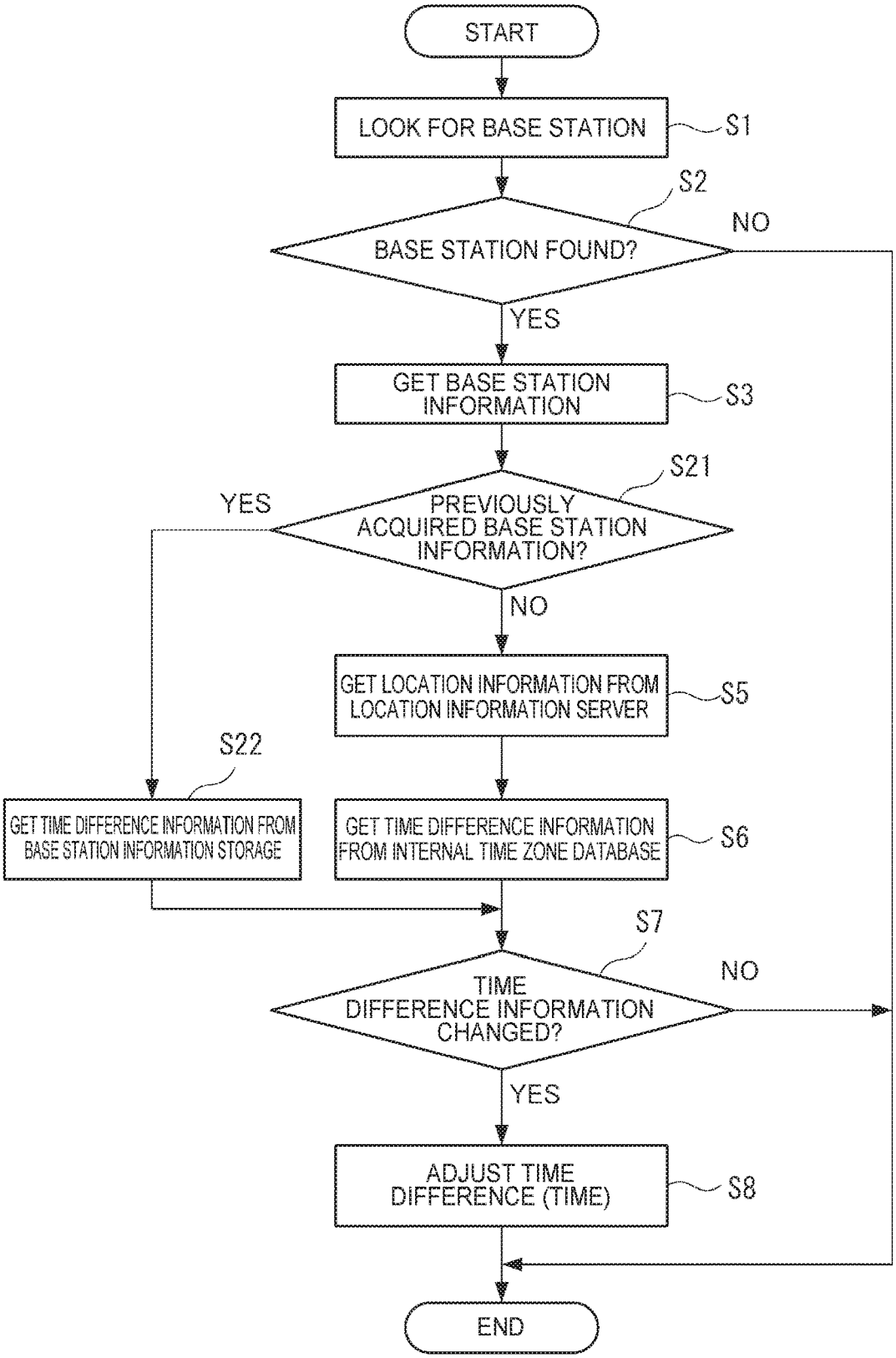
FIG. 12 is a flow chart of the time zone checking process of an electronic timepiece according to the second embodiment of the invention.
Figure 13:
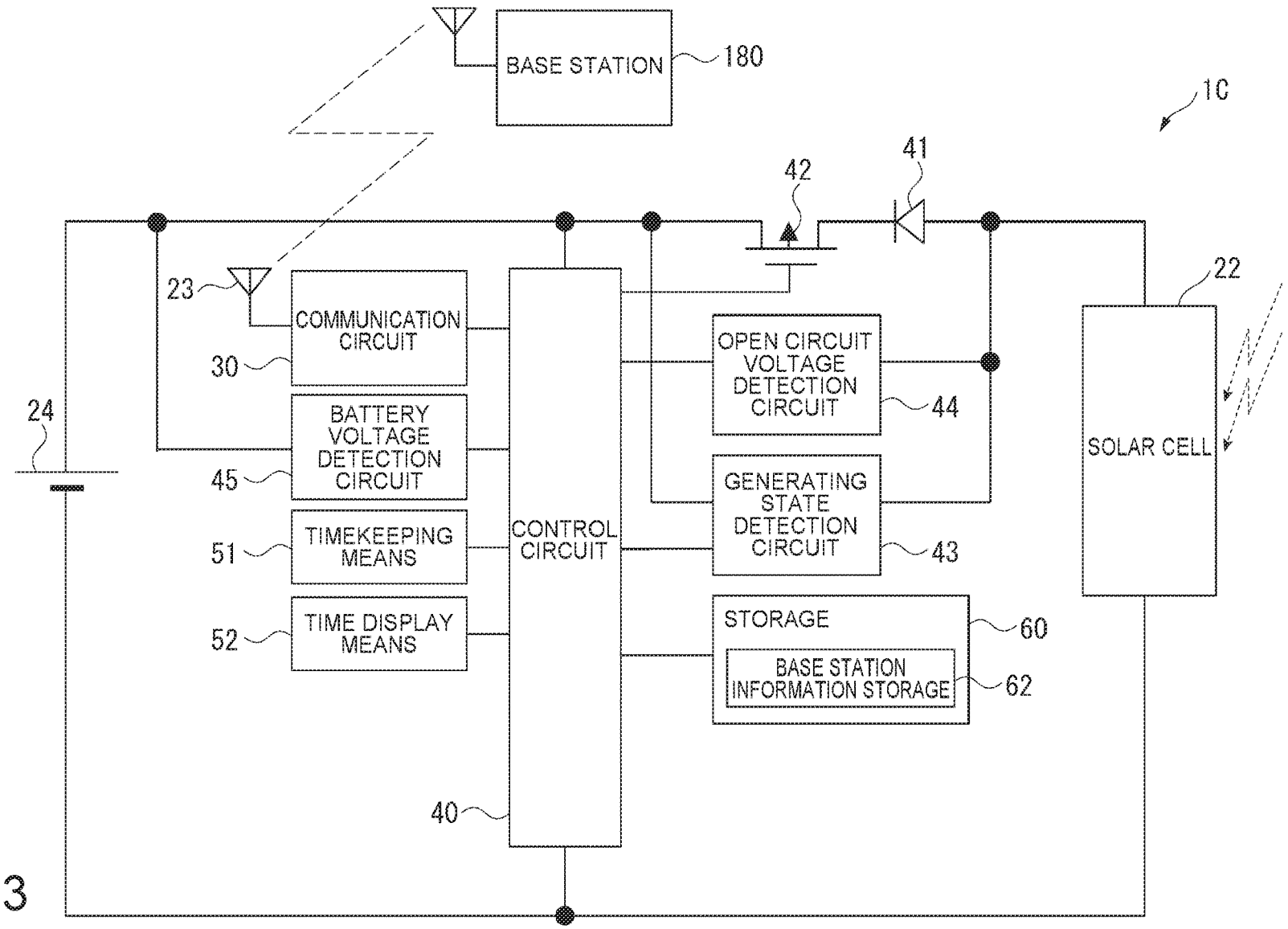
FIG. 13 is a block diagram of the circuit configuration of an electronic timepiece according to a third embodiment of the invention.

When executing the time zone checking process shown in FIG. 12, the control circuit 40 of the electronic timepiece 1 executes the same base station information acquisition process (steps S1-S3) as in the time zone checking process as in the first embodiment of the invention.

The control circuit 40 then determines, in the acquired information evaluation process, if the acquired base station information is stored in the base station information storage 62B, that is, if the same base station information was acquired and stored in the past (step S21).

If step S21 returns NO, the control circuit 40 executes the process of acquiring the location information corresponding to the base station information from the positioning information server 130 (step S5), and the process of acquiring the time difference information corresponding to the location information acquired from the time difference information storage 61 (step S6), as in the first embodiment.

If the acquired base station information is stored in the base station information storage 62B and step S21 returns YES, the control circuit 40 acquires the time difference information from the base station information storage 62B (step S22).

Next, the control circuit 40 compares the time difference acquired in step S6 or step S22 with the currently set time difference, and determines whether or not the time difference changed (step S7).

If the control circuit 40 determines in step S7 that the time difference changed, it updates the set time difference and corrects the displayed time as in the first embodiment (step S8).

However, if the control circuit 40 determines NO in step S2 or step S7, the control circuit 40 ends the time zone checking process shown in FIG. 12 without adjusting the displayed time.

Effect of Embodiment 2

The second embodiment has the same effect as the first embodiment.

Furthermore, because previously acquired base station information and time difference information are stored in the base station information storage 62B, if the base station information currently acquired is already stored in the base station information storage 62B, there is no need to acquire time zone information from the positioning information server 130, and the time difference can be acquired and updated based on the previous record. As a result, power consumption of the electronic timepiece 1B can be further reduced.

Embodiment 3

A third embodiment of the invention is described next with reference to FIG. 13 to FIG. 16.

The electronic timepieces 1 and 1B according to the first and second embodiments of the invention acquire time difference information from the time difference information storage 61 of the storage 60. However, because the electronic timepiece 1C according to the third embodiment of the invention does not have time difference information storage 61 in the storage 60, this electronic timepiece 1C acquires the time difference information from a server on the Internet 110.

In other words, the storage 60 of this electronic timepiece 1C has a base station information storage 62, but does not have time difference information storage 61.

Figure 14:
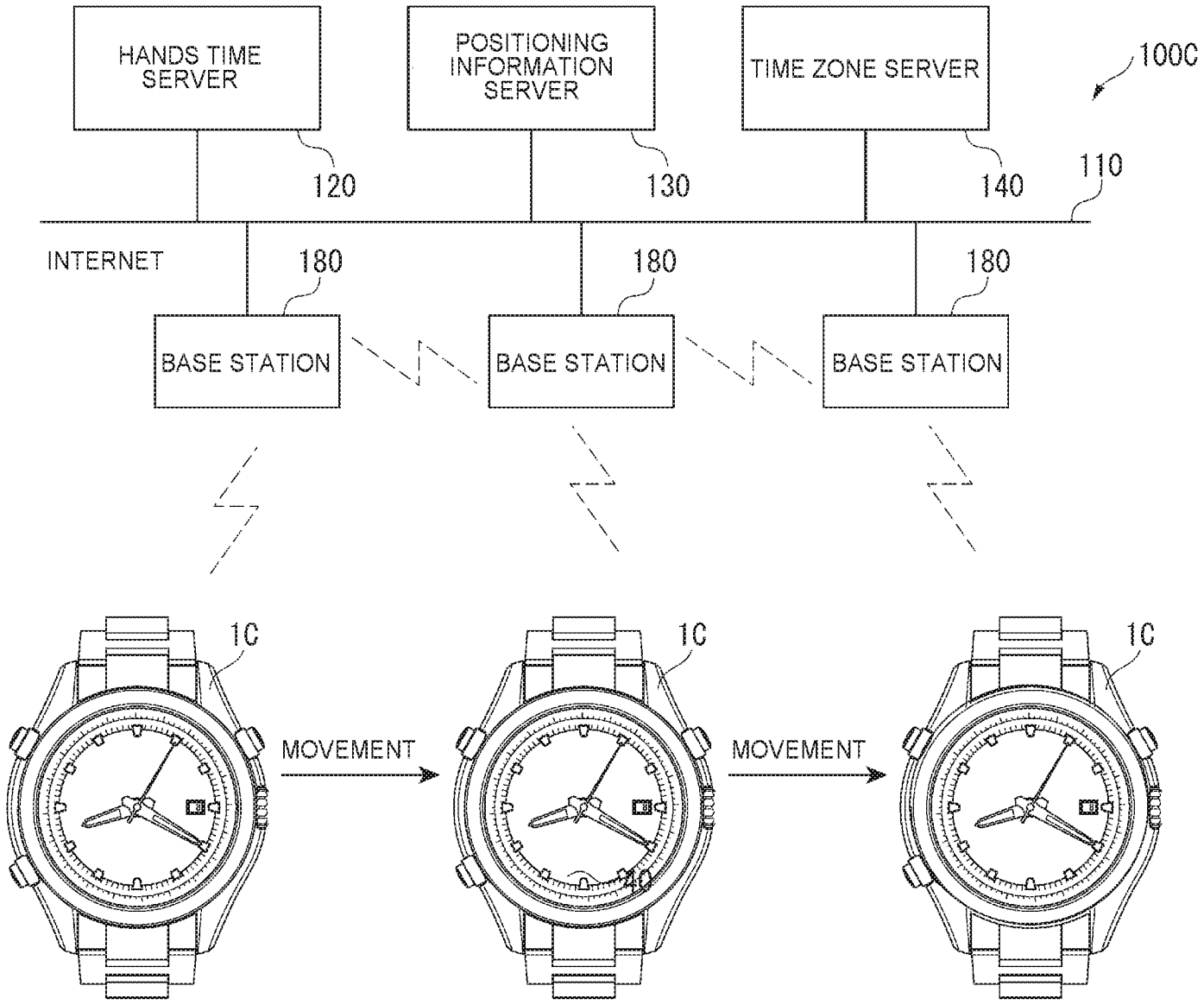
FIG. 14 illustrates the configuration of a time correction system according to a third embodiment of the invention.

As shown in FIG. 14, the time correction system 100C according to the third embodiment has a time zone server 140 in addition to a time server 120 and positioning information server 130. Note that while not shown in the figure, the time correction system 100C also has a time zone database server 160.

Similarly to the time difference information storage 61 according to the first and second embodiments of the invention, the time zone server 140 stores location information and time difference information corresponding to the location information in a time zone table 141. As shown in FIG. 15, the time zone table 141 stores coordinate data indicating the locations of the northwest and southeast corners of a rectangular area as the location information, and stores the time difference of that area to UTC as the time difference information. The time zone table 141 also stores information such as the start date and time of DST, the end date and time of DST, and the time difference during DST.

Because the storage capacity of the time zone server 140 can be greater than the storage capacity of the storage 60 in the electronic timepiece 1C, the number of rectangular areas that can be stored in the time zone table 141 can be significantly increased. As a result, each area can be identified by mesh data of the same size, time difference and DST information can be set for each mesh area, and more precise time difference information can be acquired from this time zone table 141 than time zone table 611. In addition, when a time zone changes, it is only necessary to update the time zone table 141 on the time zone server 140, there is no need for an update process to run on the electronic timepiece 1C, and the time difference can always be acquired by referencing the newest time zone data.

The time zone checking process of the electronic timepiece 1C according to the third embodiment of the invention is described next with reference to FIG. 16. Note that the same steps in the flow chart in FIG. 16 and the process of the first embodiment are identified by the same reference numerals, and further description thereof is omitted.

Figure 16:
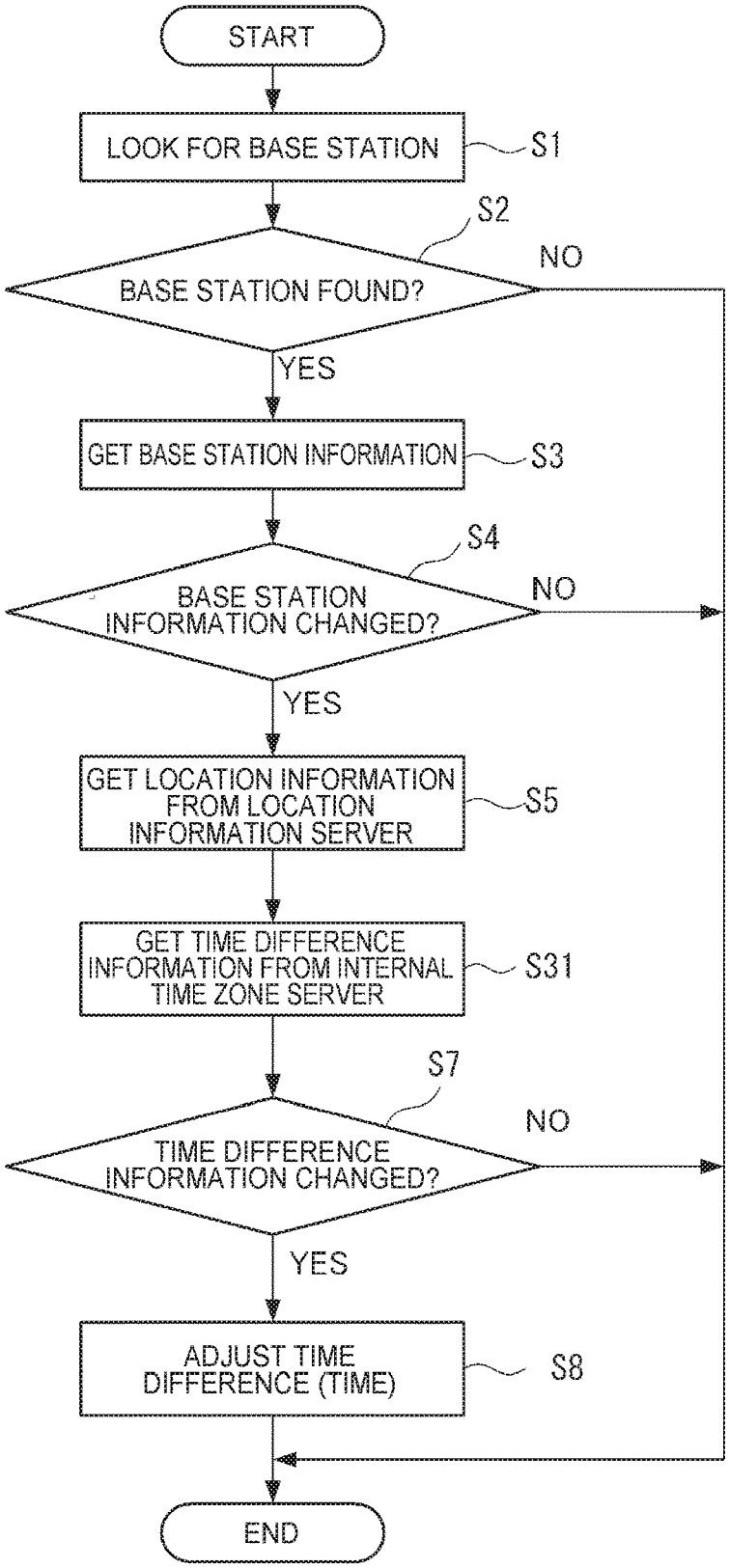
FIG. 16 is a flow chart of the time zone checking process of an electronic timepiece according to the third embodiment of the invention.

When executing the time zone checking process shown in FIG. 16, the control circuit 40 of the electronic timepiece 1C executes the same base station information acquisition process (steps S1-S3) as in the time zone checking process as in the first embodiment, and then executes the acquired information evaluation process (step S4).

If YES is returned in the acquired information evaluation process in step S4, the control circuit 40 executes the process of acquiring the location information corresponding to the base station information from the positioning information server 130 (step S5).

Next, control circuit 40 executes a time difference information acquisition process of outputting the acquired location information to the time zone server 140, and acquiring the time difference from the time zone server 140 (step S31).

Next, the control circuit 40 compares the time difference information acquired in step S31 with the time difference information that is currently set, and determines if there was a change (step S7).

If the control circuit 40 determines in step S7 that the time difference information changed, it updates the time difference information set in the timekeeping means 51 and corrects the displayed time as described in the first embodiment (step S8).

However, if NO is returned in step S2, S4, or S7, the time zone checking process shown in FIG. 16 ends without correcting the time difference (time).

Effect of Embodiment 3

The third embodiment has the same effect as the first embodiment.

In addition, because the electronic timepiece 1C acquires time difference information from the time zone server 140, there is no need for time difference information storage 61 in the electronic timepiece 1C. The storage capacity of the storage 60 required in the electronic timepiece 1C can therefore be reduced, and time difference information storage 61 maintenance is unnecessary.

In addition, because the storage capacity of the time zone server 140 is not particularly limited, the correlation between location information and time difference information can be set in great detail, and precise time difference information can be acquired if the time difference information is acquired from the time zone server 140.

Embodiment 4

A fourth embodiment of the invention is described next with reference to FIG. 17 to FIG. 20.

The embodiments described above immediately change the time difference and correct the displayed time when the received time difference differs from the currently set time difference. An electronic timepiece 1D according to the fourth embodiment of the invention, however, corrects the displayed time when a change in the time difference is consecutively detected multiple times.

Figure 17:
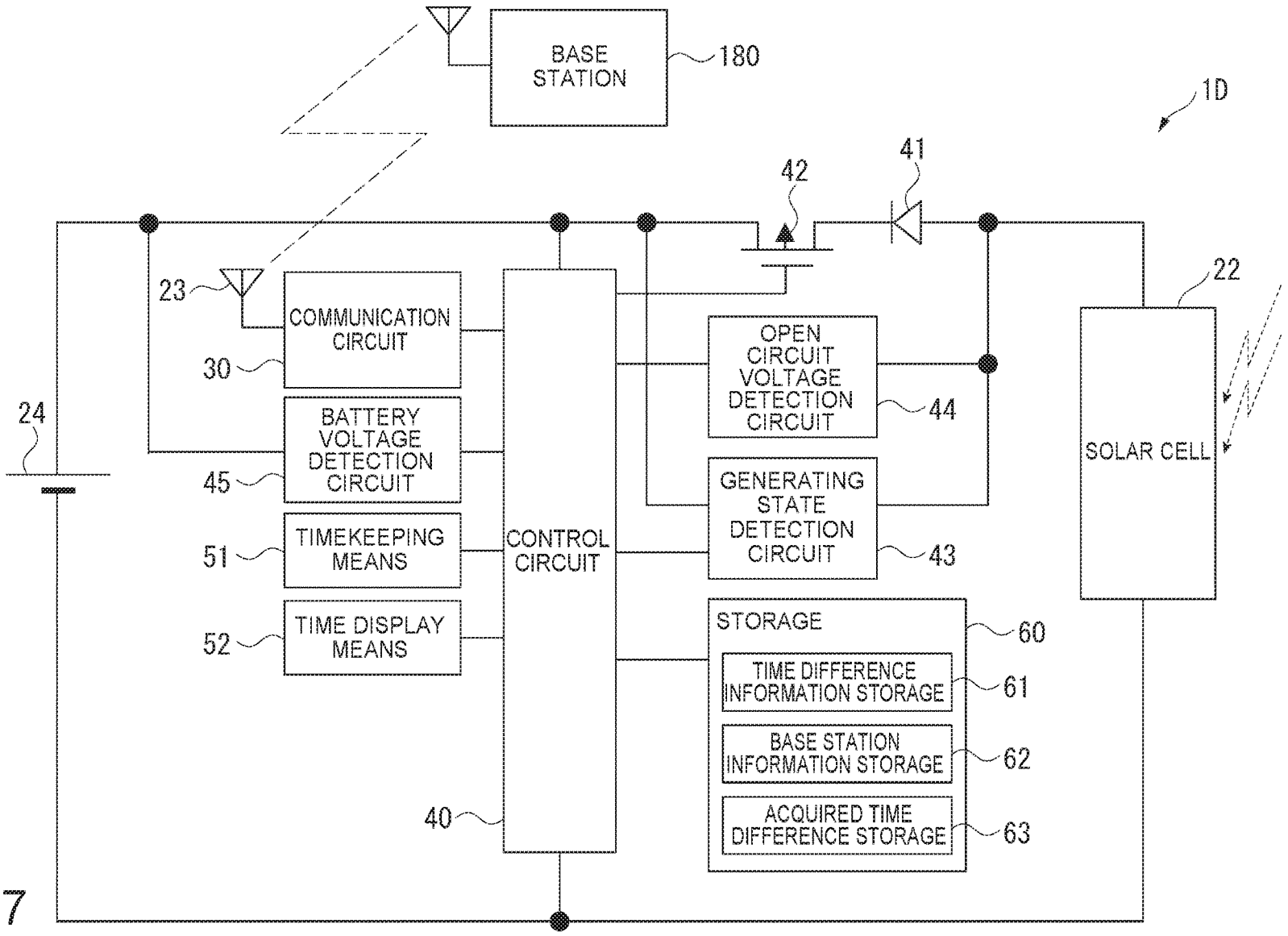
FIG. 17 is a block diagram of the circuit configuration of an electronic timepiece according to a fourth embodiment of the invention.

As a result, as shown in FIG. 17, the electronic timepiece 1D is the same as the foregoing embodiments except for also having acquired time difference storage 63 that stores the acquired time difference. The configuration on the network side of the time correction system according to the fourth embodiment of the invention is the same as in the first and second embodiments, and further description thereof is therefore omitted.

The time zone checking process of the electronic timepiece 1D according to the fourth embodiment of the invention is described next with reference to the flow charts in FIG. 18 and FIG. 19. If changed time difference is acquired multiple times consecutively (twice in this embodiment) is determined in this fourth embodiment by executing the first time zone checking process shown in FIG. 18 and the second time zone checking process shown in FIG. 19 in stages, and then corrects the time difference if changed time difference information is acquired twice consecutively. Note that processes in FIG. 18 and FIG. 19 that are the same as in the first embodiment are identified by the same reference numerals, and further description thereof is omitted.

Figure 18:
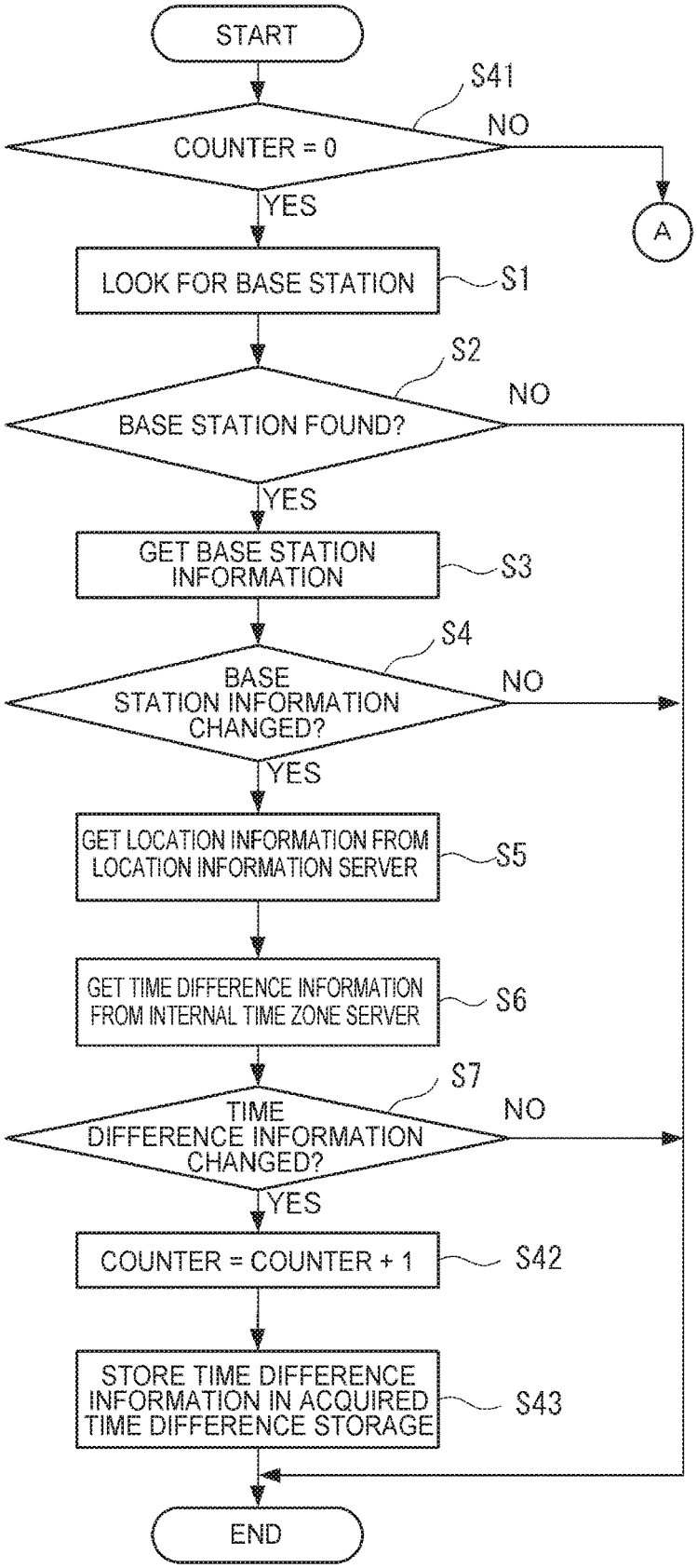
FIG. 18 is a flow chart of a first time zone checking process of an electronic timepiece according to the fourth embodiment of the invention.

If the counter (variable) for counting the number of consecutive times time difference information has been acquired has not been initialized before the first time zone checking process shown in FIG. 18 starts, the control circuit 40 of the electronic timepiece 1D sets the counter to 0.

The control circuit 40 therefore first checks if the value of the counter is 0 (step S41). Because the initialized value of the counter is 0, the control circuit 40 returns YES in step S41.

If step S41 returns YES, the control circuit 40 executes the same base station information acquisition process (steps S1-S3) as in the time zone checking process, acquired information evaluation process (step S4), and time zone information acquisition process (step S5-S6) as in the time zone checking process of the first embodiment.

As in the first embodiment, the control circuit 40 then determines if the time difference information acquired in step S6 is different from the time difference information currently set in the timekeeping means 51 (step S7).

If the control circuit 40 determines in step S7 that the time difference information changed, the time difference (time) is then corrected in step S8 in the first embodiment. In this embodiment, however, the control circuit 40 updates the value of the counter to 1 (step S42), stores the acquired time difference information in the acquired time difference storage 63 (step S43), and ends the time zone checking process.

If step S2, S4, or S7 returns NO, the control circuit 40 ends the time zone checking process without setting the counter to 1.

When a first time interval (such as 10 minutes) has passed since the last time zone checking process ended, the control circuit 40 executes the time zone checking process shown in FIG. 18 again. If the value of the counter was set to 1 in the previous time zone checking process, that is, a change in the time difference information was detected, the control circuit 40 returns NO in step S41, and goes to the second time zone checking process shown in FIG. 19.

However, if the value of the counter in the previous time zone checking process is still 0, that is, a change in the time difference information was not detected, or time difference information was not acquired, the control circuit 40 again executes the first time zone checking process shown in FIG. 18.

Second Time Zone Checking Process

Figure 19:
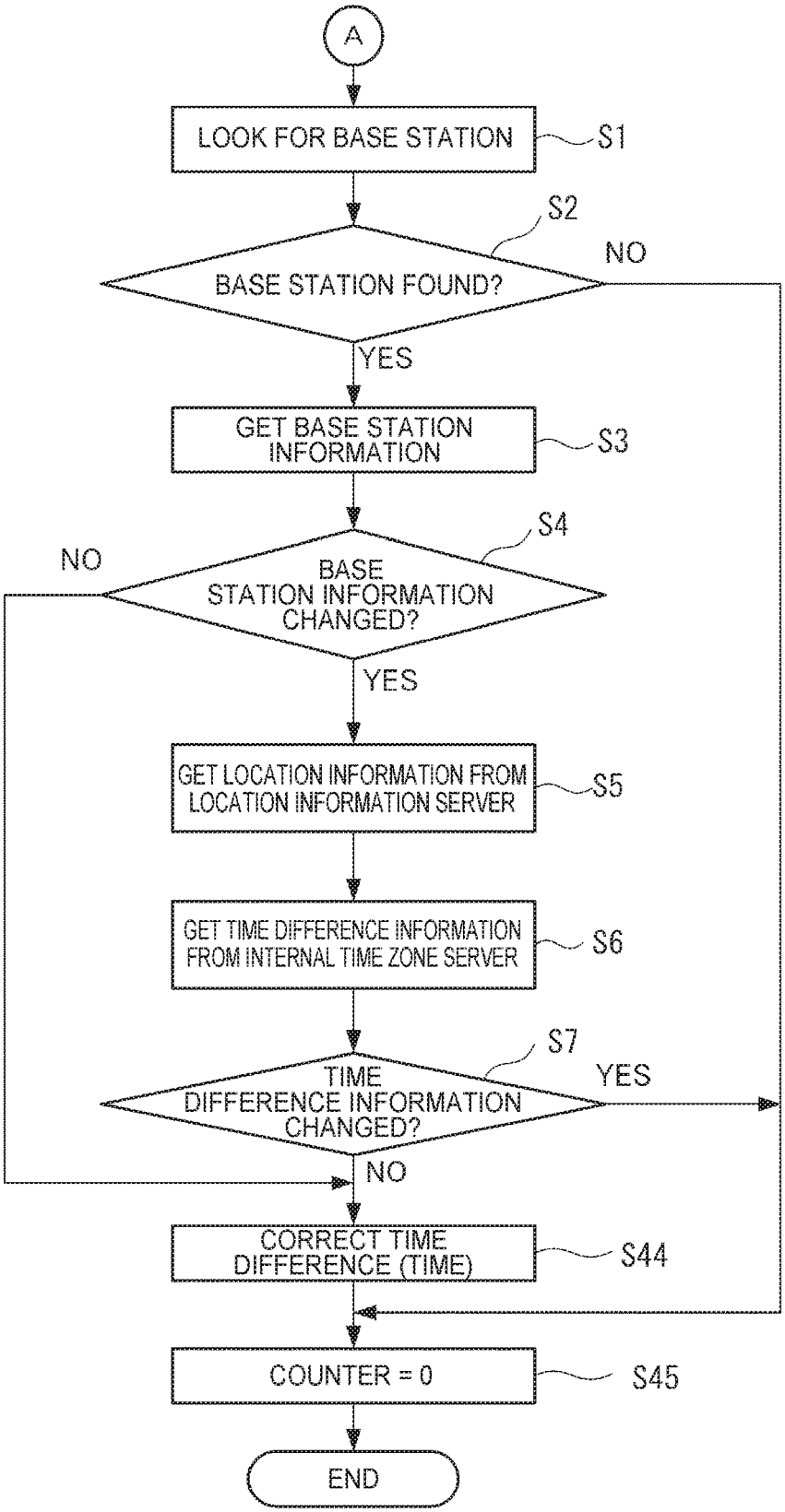
FIG. 19 is a flow chart of a second time zone checking process of an electronic timepiece according to the fourth embodiment of the invention.

In the second time zone checking process shown in FIG. 19, the control circuit 40 executes the base station information acquisition process (step S1-S3), acquired information evaluation process (step S4), and time zone information acquisition process (step S5-S6) as in the first time zone checking process.

If step S4 returns NO because the base station information is the same as the base station information acquired in the first time zone checking process, or step S7 returns NO because the base station information changed but the acquired time difference information has not changed from the time difference information acquired in the first time zone checking process, the control circuit 40 corrects the time difference (time) (step S44).

The second time zone checking process therefore only executes if the base station information changed and the time difference information changed in the first time zone checking process.

Therefore, if the base station information acquired in the first time zone checking process and the base station information acquired in the second time zone checking process are the same (step S4 returns NO), the electronic timepiece 1D has connected to the same base station twice consecutively after the user wearing the electronic timepiece 1D moved to a different time zone. In this event, there is a strong possibility that the correct time can be displayed by changing the displayed time to the time zone of the base station.

In addition, if the base station information acquired in the second time zone checking process is different but the acquired time difference information is the same (step S7 returns NO), the person wearing the electronic timepiece 1D has moved to a different time zone and the electronic timepiece 1D then connected to two different base stations, but those base stations are in the same time zone. As a result, there is a strong possibility that the correct time can be displayed by changing the displayed time to that time zone.

After executing the time difference correction process in step S44, and if NO is returned in step S2, S7 in the second time zone checking process, the control circuit 40 resets the counter to 0 (step S45). As a result, the first time zone checking process will execute the next time (after the time interval of 10 minutes in this example).

The time zone checking process of the electronic timepiece 1D is further described with reference to the example shown in FIG. 20.

Figure 20:
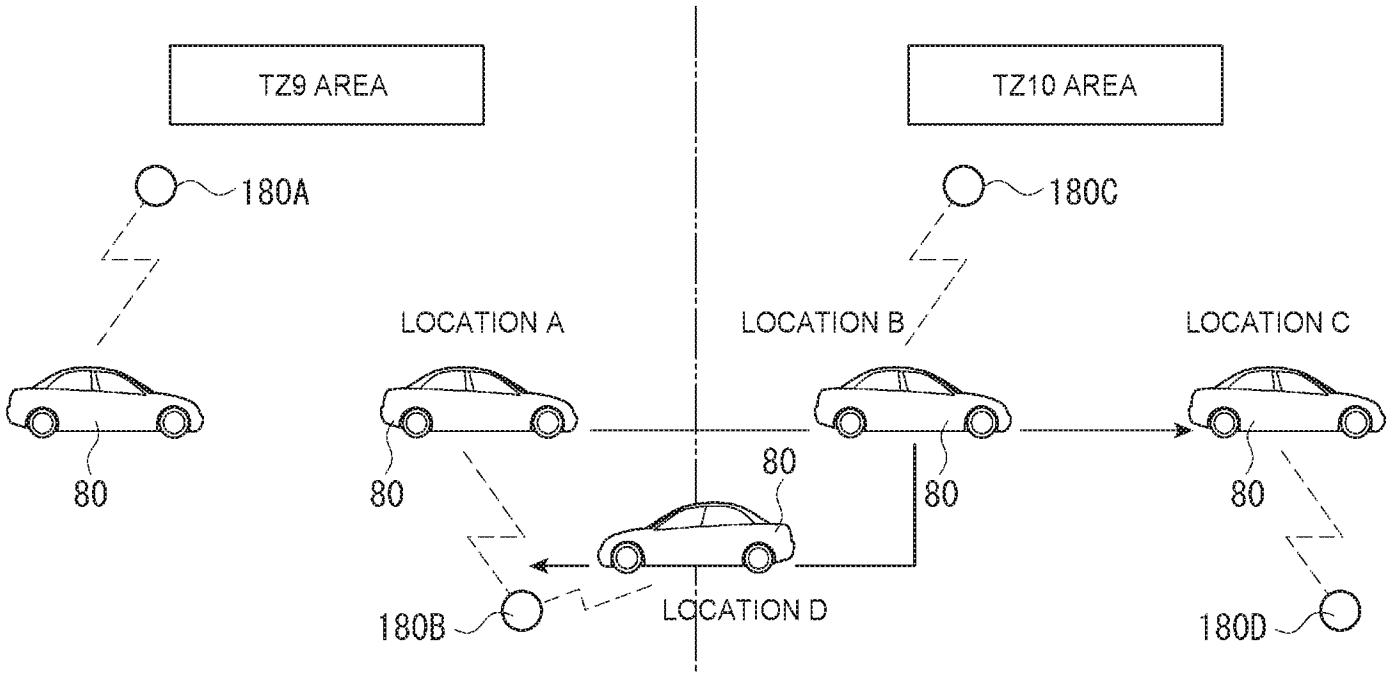
FIG. 20 illustrates an example of the time zone checking process of an electronic timepiece according to the fourth embodiment of the invention.

In the example in FIG. 20, area TZ9 and area TZ10 are adjacent, and the user riding in car 80 is wearing the electronic timepiece 1D. As a result, when connected to base station 180A and 180B in TZ9, the electronic timepiece 1D acquires the time difference in TZ9 (UTC+1, for example), and when connected to base station 180C and 180D in TZ10, the electronic timepiece 1D acquires the time difference in TZ10 (UTC+2, for example).

When the car 80 is at location A, the electronic timepiece 1D is set to the time difference in TZ9 and displays the time in TZ9. When the car 80 then crosses time zones, moves to location B in TZ10, and the electronic timepiece 1D connects to base station 180C, the electronic timepiece 1D executes the first time zone checking process and acquires the time difference in TZ10. However, because this is the first time the electronic timepiece 1D acquires the change in time difference information from TZ9 to TZ10, the control circuit 40 stores the acquired time difference in the acquired time difference storage 63, increments the counter to 1, and does not change the displayed time.

If the car 80 then moves from location B to location C and connects to base station 180D when the time zone checking process executes next, the control circuit 40 returns NO in step S41, and executes the second time zone checking process shown in FIG. 19. The control circuit 40 then returns YES in step S4 in FIG. 19, and acquires the same time difference information for TZ10 as the last time in step S6, and returns NO in step S7. As a result, the control circuit 40 corrects the time difference in step S44, and changes the displayed time from the time in TZ9 to the time in TZ10

However, if the next time the time zone checking process executes the car 80 has moved from location B to location D (instead of to location C), returns to TZ9 and connects to base station 180B, the control circuit 40 returns NO in step S41 and executes the second time zone checking process shown in FIG. 19. The control circuit 40 then returns YES at step S4 in FIG. 9, in step S6 acquires time difference information for TZ9, which is different from the time difference last acquired in TZ10, and returns YES in step S7. As a result, the control circuit 40 does not correct the time difference in step S44, and keeps the displayed time at the time in TZ9.

As a result, if the car 80 briefly moves to a location B in TZ10 and then quickly returns to TZ9, the control circuit 40 of the electronic timepiece 1D does not correct the displayed time. However, if the car 80 continues from location B to location C and remains in the same TZ10 when the time zone checking process executes twice consecutively, the control circuit 40 changes the displayed time, and the displayed time can be corrected appropriately.

Effect of Embodiment 4

The fourth embodiment has the same effect as the first embodiment.

In addition, because the actual time difference is changed when the acquired time difference information has changed and the new time difference information is acquired twice consecutively, the displayed time can be corrected when movement to a different time zone has been reliably detected, and user convenience can be improved.

Note that the number of times the same time difference must be acquired is not limited to two, and may be three or more times. The reliability of detecting movement to a different time zone can be improved by increasing this number of times, but because this increases the time lag until the displayed time is corrected, this number of times is preferably balanced with the desirable time lag.

Embodiment 5

A fifth embodiment of the invention is described next with reference to FIG. 21 to FIG. 24.

An electronic timepiece 1E described as an example of an electronic device according to the fifth embodiment of the invention differs from the foregoing embodiments by also having a mode selection function for setting the conditions for automatically correcting the time difference, and a time zone resetting function for manually returning the time zone setting to the previous setting when the time zone has been changed automatically. Note that the configuration on the network side of the time correction system according to the fifth embodiment of the invention is the same as in the first embodiment, and further description thereof is therefore omitted.

Figure 21:
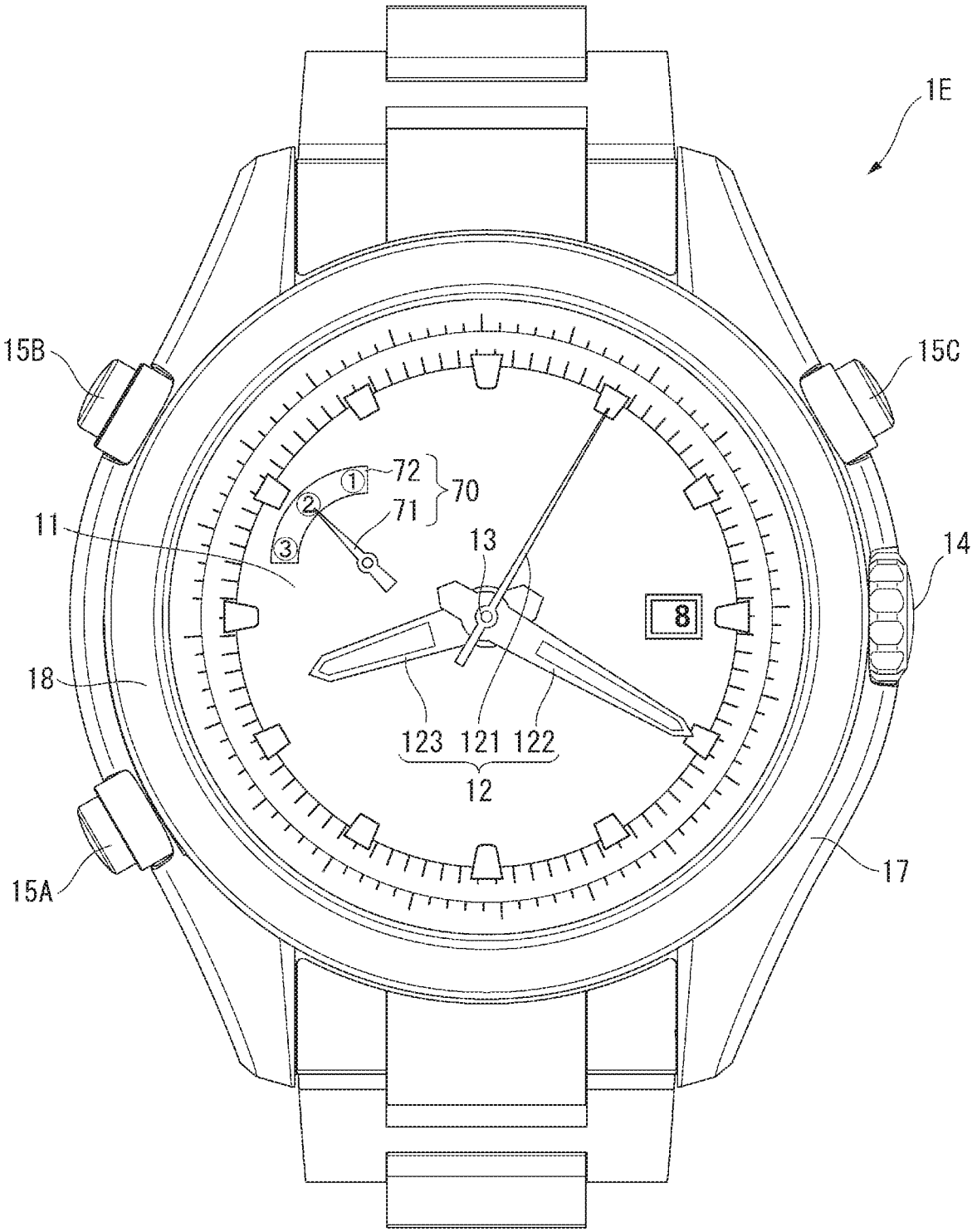
FIG. 21 is a front view an electronic timepiece according to a fifth embodiment of the invention.
Figure 22:
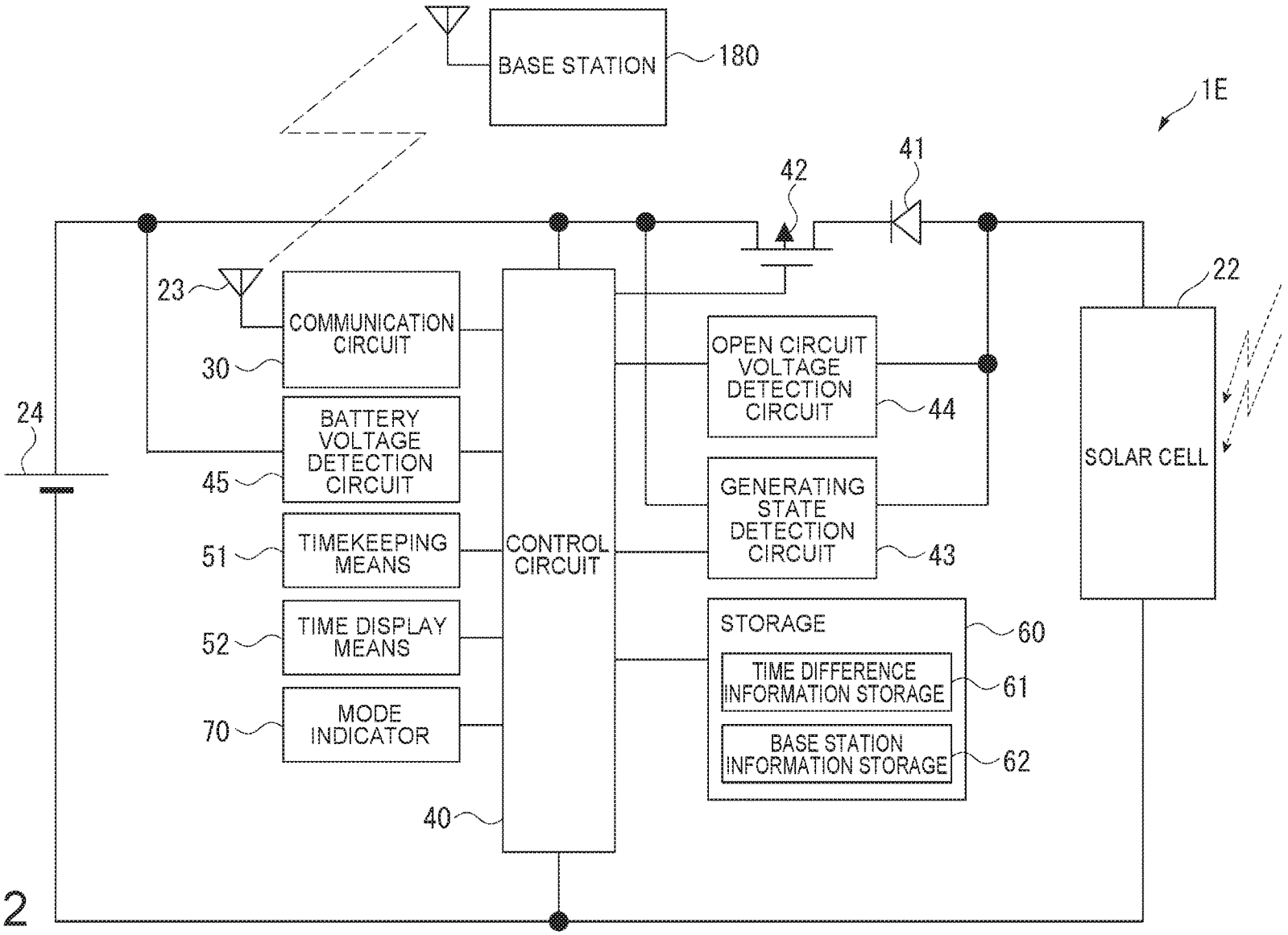
FIG. 22 is a block diagram of the circuit configuration of an electronic timepiece according to the fifth embodiment of the invention.

As shown in FIG. 21 and FIG. 22, the electronic timepiece 1E has a mode indicator 70 that indicates the selected mode. The mode indicator 70 includes a mode hand 71 and a dial 72 of markers to which the mode hand 71 points.

In this embodiment there are three automatic correction condition selection modes that can be selected using the mode indicator 70, and the user selects the desired mode before the time zone checking process executes. More specifically, when the user pushes a specific button (button 15B in this example), the control circuit 40 sequentially changes the condition selection mode between mode 1, mode 2, and mode 3. The control circuit 40 sequentially moves the mode hand 71 of the mode indicator 70 to the marker corresponding to the first to third mode (indicated by circled numbers 1 to 3 on the dial 72 in this example).

In addition, if the button 15B is pushed when the mode hand 71 is pointing to mode 3, the control circuit 40 jumps the mode hand 71 from mode 3 to mode 1, and each time the button 15B is pushed thereafter, moves the mode hand 71 to the next mode marker in the sequence.

In mode 1, as in the first to third embodiments described above, the time difference (time) is changed each time the time difference information is detected to have changed. For example, if the time zone checking process executes at a 10 minute interval, and the user is riding in a car travelling at 60 km/hour, the car moves 10 km in 10 minutes. Therefore, if the user travels from one time zone (TZ9) to a different time zone (TZ10), for example, and the acquired time difference information changes, there is a strong possibility of communicating with a base station 180 at a location in the time zone TZ10 separated from TZ9, and the likelihood of the correct time being set is high.

Mode 1 is therefore effective when travelling between time zones on a vehicle such as a car, train, or plane travelling at a high speed.

As in the fourth embodiment, in mode 2 the time difference (time) is corrected when a change in time difference information is detected multiple times consecutively (at least twice). For example, if the time zone checking process executes at a 10 minute interval and the user is walking at approximately 4 km/hour, the user moves approximately 670 meters in 10 minutes. Therefore, when the user walks from one time zone (TZ9) to a different time zone (TZ10) and the acquired time difference information changes to TZ10, the user will not be far from TZ9 and time difference information for TZ9 may still be acquired. However, if the time difference information changes from TZ9 to TZ10, and TZ10 is again detected the next time the time zone checking process executes, travelling in TZ10 can be more reliably detected, and the probability of setting the correct time is higher.

This mode 2 is therefore effective when travelling between time zones at a slow speed.

The time zone checking process is not executed in mode 3. For example, if the user lives near a boundary between different time zones and does not travel into the different time zone, but a base station 180 in the different time zone is nearby, the electronic timepiece 1E may communicate with that base station 180 and mistakenly set the wrong time. Mode 3 is to prevent the time zone checking process from executing in such circumstances.

The time zone checking process of the electronic timepiece 1E according to the fifth embodiment of the invention is described next with reference to FIG. 23.

Figure 23:
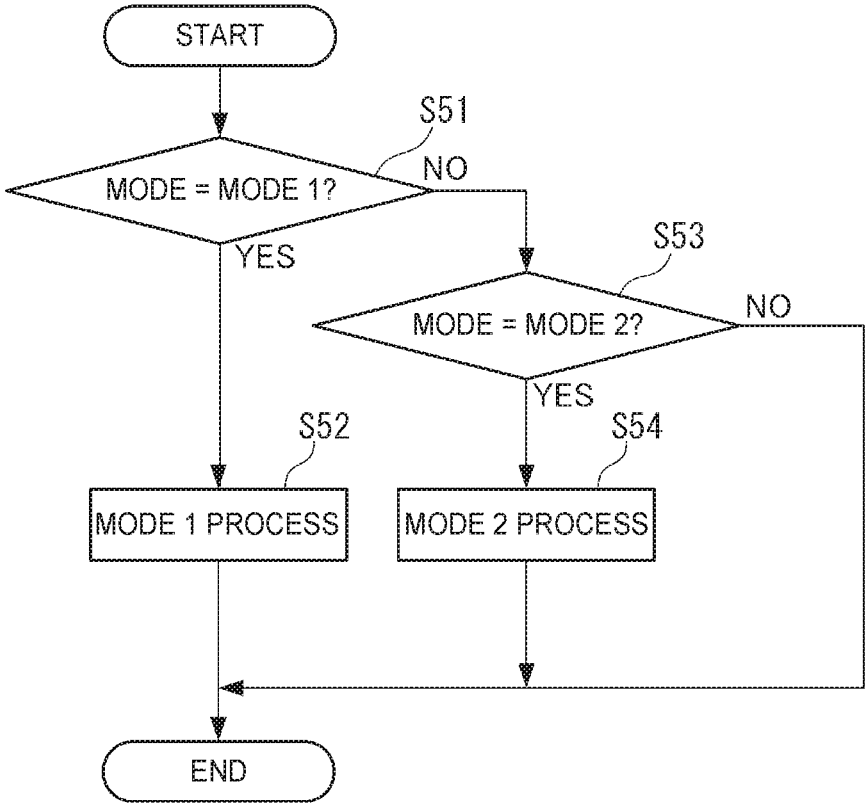
FIG. 23 is a flow chart of the time zone checking process of an electronic timepiece according to the fifth embodiment of the invention.

When the time zone checking process shown in FIG. 23 executes at a first time interval (such as 10 minutes), the control circuit 40 of the electronic timepiece 1E first determines if the set mode is mode 1 (step S51). If the user has previously operated the button 15B to set mode 1 and step S51 returns YES, the control circuit 40 executes the mode 1 process (step S52).

The mode 1 process is the same as the time zone checking process shown in FIG. 7 in the first embodiment, and further description thereof is omitted. As a result, in the mode 1 process, the time difference (time) is corrected when a change in the time difference information is detected.

If step S51 returns NO, the control circuit 40 determines if the set mode is mode 2 (step S53). If mode 2 is set and step S53 returns YES, the control circuit 40 executes the mode 2 process (step S54).

The mode 2 process is the same as the time zone checking process shown in FIG. 18 and FIG. 19 in the fourth embodiment, and further description thereof is omitted. As a result, in the mode 2 process, the time difference (time) is corrected when a change in the time difference information is detected twice consecutively.

If step S53 returns NO, the control circuit 40 knows the set mode is mode 3, and ends operation without executing the mode 1 or mode 2 process.

Time Zone Resetting Function

Because the time zone checking process executes automatically when mode 1 or mode 2 is set, the time difference may be changed unintentionally and the displayed time also changed particularly in areas close to the boundary between time zones. For example, if the user travels from one time zone (TZ9) to a different time zone (TZ10), for example, and the time difference is changed to TZ10, the electronic timepiece 1E then communicates with a base station 180 in TZ9, and the time difference is unintentionally changed to the time difference in TZ9, the user can, by a simple operation, reset the time to the time difference in TZ10. User convenience is therefore good.

Therefore, the control circuit 40 of the electronic timepiece 1E according to this embodiment has a time zone resetting function for resetting the previous time difference setting when mode 1 or mode 2 is set and a specific operation (pushing button 15A in this embodiment of the invention) is performed.

Figure 24:
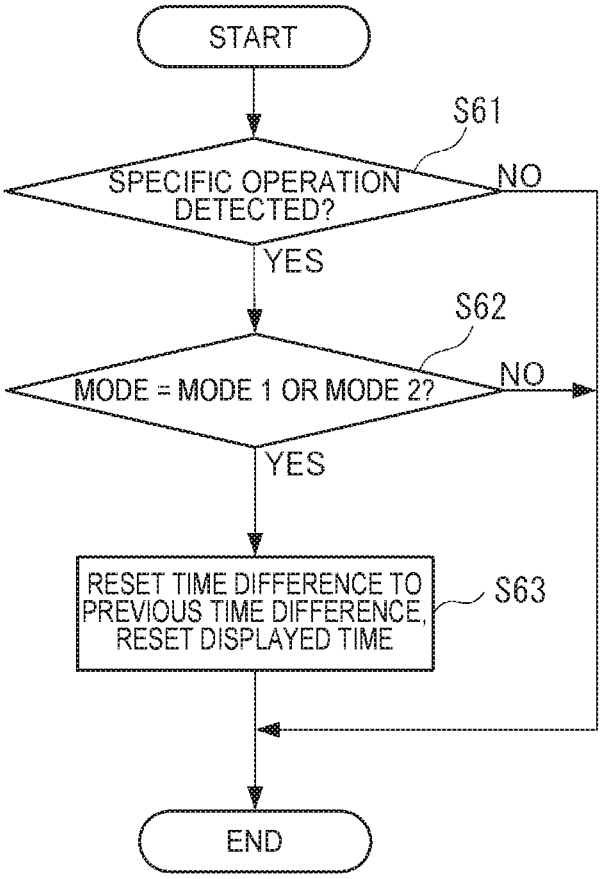
FIG. 24 is a flow chart of the time zone resetting process of the electronic timepiece according to the fifth embodiment of the invention.

More specifically, as shown in FIG. 24, the control circuit 40 determines if the user pushed button 15A (performed the specific operation) (step S61).

If button 15A was pushed and step S61 returns YES, the control circuit 40 determines if mode 1 or mode 2 is set (step S62).

If mode 1 or mode 2 is set, the control circuit 40 returns the time difference setting to the previous setting, and adjusts the displayed time (step S63). For example, if mode 1 or mode 2 is set, the time difference information is automatically changed from +1 to +2, and the button 15A is pushed, the control circuit 40 returns the time difference information from +2 to +1 and corrects the displayed time.

Effect of Embodiment 5

Because an electronic timepiece 1E according to this embodiment changes the conditions for time difference correction according to the mode previously set by the user, the time difference can be corrected according to the conditions appropriate to the needs of each user.

Furthermore, because the previously set time difference can be reset by pushing button 15A when mode 1 or mode 2 is set and the time difference is changed automatically, this electronic timepiece 1E can easily return to the previous time zone setting if the time difference is changed against the intent of the user, and user convenience can be improved.

Note that there are no specific limits set in the electronic timepiece 1E on the special process for returning to the previous time difference setting by the specific operation, but a time limit, for example, may be applied to the special process. For example, the special process for resetting the time difference by pushing the button 15A may be limited to a specific time (such as 6 hours, 12 hours, or 24 hours) after the time difference is changed automatically in mode 1 or mode 2.

This prevents returning to the previous time zone setting when the button 15A is pushed by mistake a specific time after the time difference is changed.

Furthermore, when button 15A is pushed and the previous time zone is restored, the control circuit 40 may change to mode 3. When the previous time zone is restored by pushing the button 15A, there is a strong possibility that the wrong time zone was set by automatic correction of the time difference setting. As a result, if mode 1 or mode 2 remains set, there is a good possibility that the time zone may be changed again. As a result, when the time zone is manually restored to the previous setting, changing to mode 3 can prevent the time zone being automatically changed again.

Embodiment 6

A sixth embodiment of the invention is described next with reference to FIG. 25 to FIG. 27.

In the time correction system 100C according to the third embodiment of the invention, the positioning information server 130 and time zone server 140 are on the Internet 110.

Figure 25:
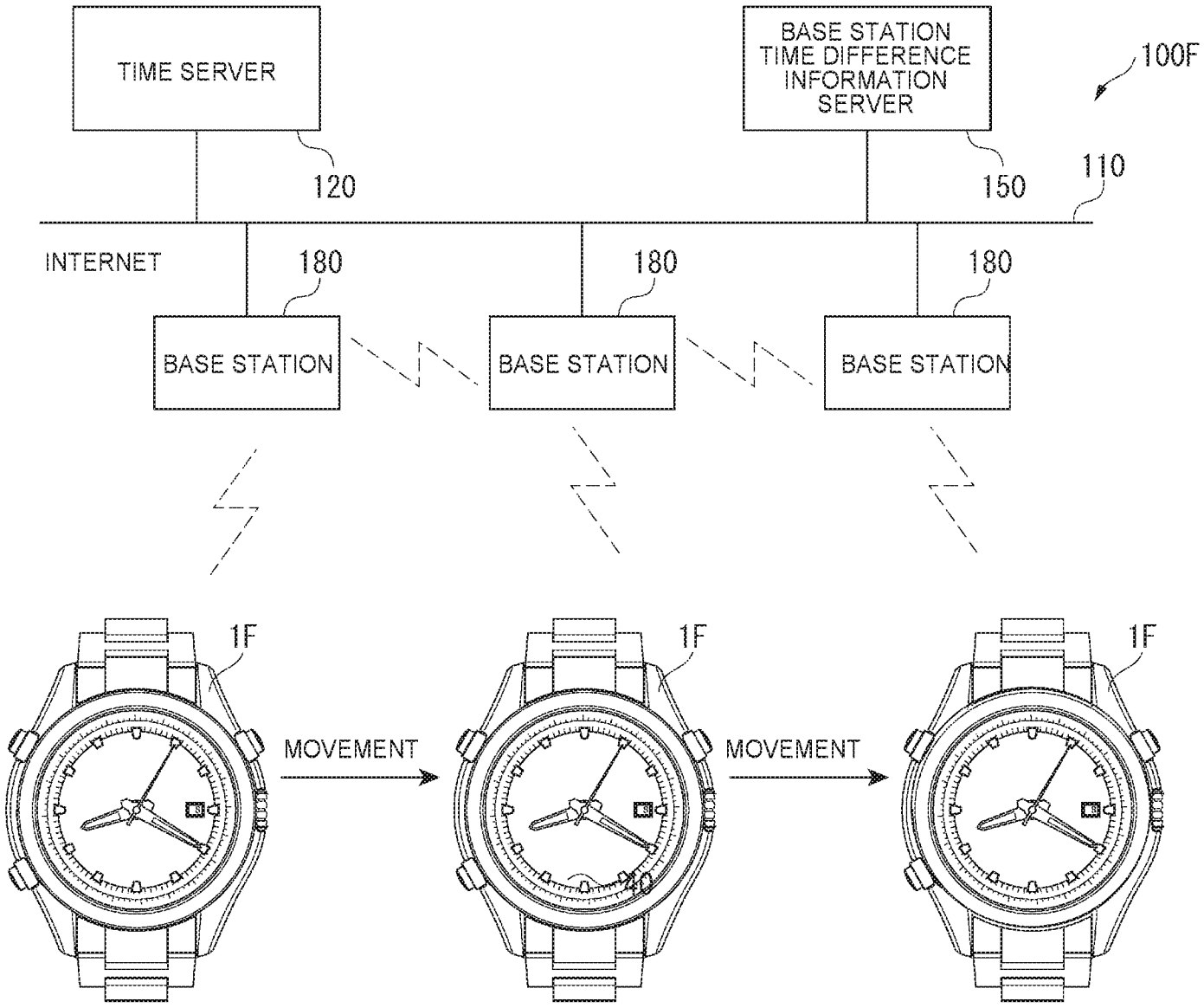
FIG. 25 shows the configuration of a time correction system according to a sixth embodiment of the invention.

As shown in FIG. 25, in the time correction system 100F according to the sixth embodiment of the invention, a base station time difference information server 150 is provided instead of the positioning information server 130 and time zone server 140.

As shown in FIG. 26, the base station time difference information server 150 stores a table 151 relationally storing base station information (MAC address) to time difference information for the location of the base station identified by the base station information.

The time zone checking process of the electronic timepiece 1F described as an example of an electronic device according to the sixth embodiment of the invention is described with reference to FIG. 27. Note that processes in FIG. 27 that are the same as in the third embodiment are identified by the same reference numerals, and further description thereof is omitted.

Figure 27:
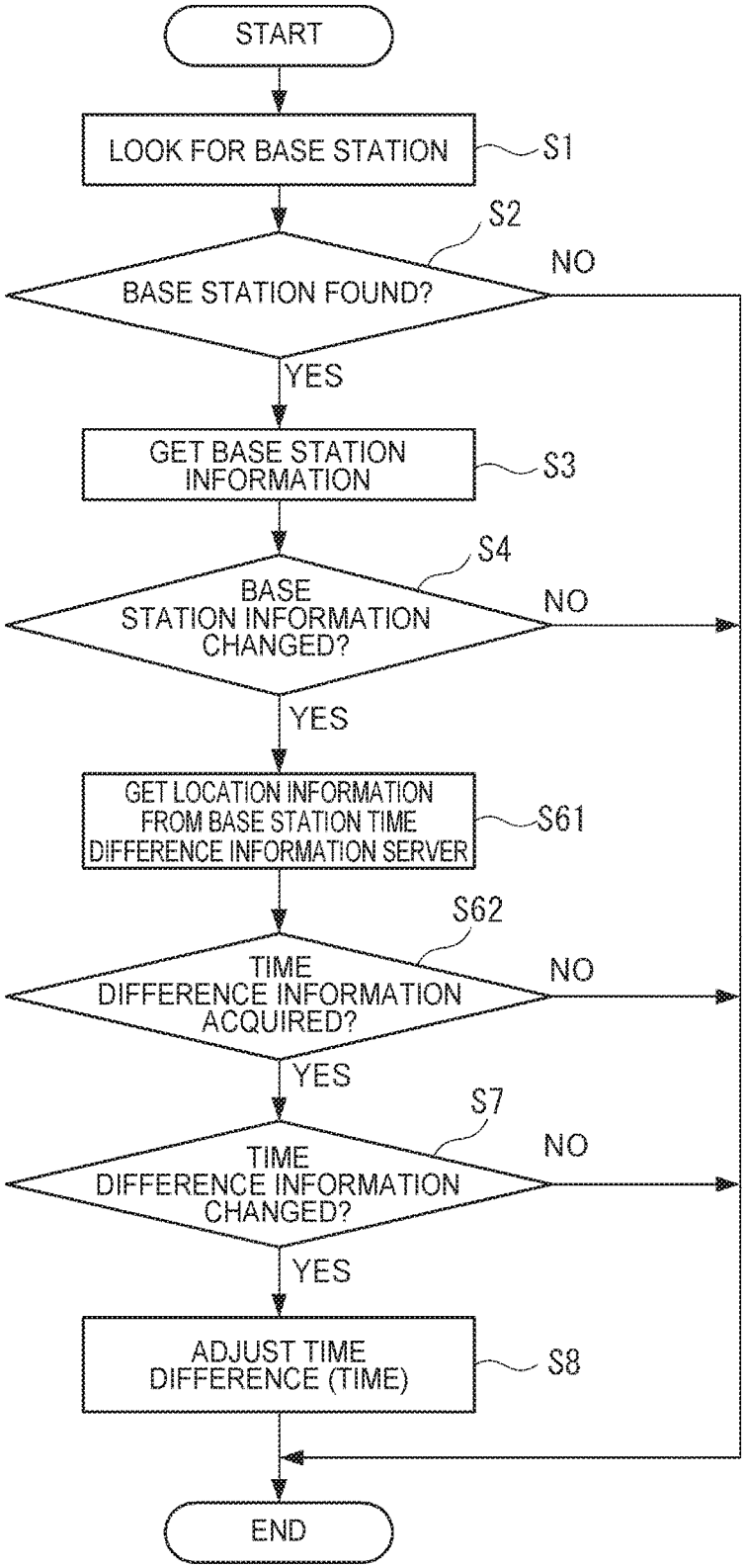
FIG. 27 is a flow chart of the time zone checking process of an electronic timepiece according to the sixth embodiment of the invention.

When executing the time zone checking process shown in FIG. 27, the control circuit 40 of the electronic timepiece 1F executes the same base station information acquisition process (step S1-S3), and acquired information evaluation process (step S4) as in the time zone checking process according to the third embodiment.

If the acquired information evaluation process S4 returns YES, the control circuit 40 outputs the acquired base station information (MAC address) to the base station time difference information server 150, and acquires time difference information corresponding to the base station information from the base station time difference information server 150 (step S61).

Next, the control circuit 40 determines if time difference information was acquired (step S62). For example, if the base station information is not registered in the base station time difference information server 150, the base station time difference information server 150 returns to the electronic timepiece 1F information indicating the base station information is not available. The control circuit 40 thus knows that time difference information could not be acquired.

If time difference information is acquired and step S62 returns YES, the control circuit 40 compares the acquired time difference information with the time difference information that is currently set, and determines if the information changed (step S7).

If step S7 determines the time difference information changed, the control circuit 40 updates the set time difference information and corrects the displayed time as in the third embodiment (step S8).

However, if NO is returned in step S2, S4, S62, or S7, the control circuit 40 ends the time zone checking process shown in FIG. 27 without changing the displayed time.

Note that if the base station time difference information server 150 determines based on access through a base station 180 that base station information for the base station 180 is not registered, the base station time difference information server 150 preferably notifies and prompts the base station time difference information server 150 administrator to add the information.

Effect of Embodiment 6

Because the time correction system 100F according to the sixth embodiment does not require a positioning information server 130 and time zone server 140 as in the third embodiment, the server installation cost can be reduced.

In addition, the electronic timepiece 1F can acquire time difference information by simply sending the acquired base station information to the base station time difference information server 150, the number of communications can be reduced by half and the power consumption of the electronic timepiece 1F can be reduced, compared with the time correction system 100C of the third embodiment, which must transmit base station information to acquire location information, and then transmit the location information to acquire the time difference information.

Other Embodiments

The invention is not limited to the embodiments described above, and can be modified and improved in many ways without departing from the scope of the accompanying claims.

The timing of the first time zone checking process and second time zone checking process of the electronic timepiece 1D described in the fourth embodiment are the same. More specifically, when the first time zone checking process executes at a first time information (10 minutes in this example), different time difference information is acquired, and the counter is then set to 1, the second time zone checking process is executed after the same first time interval (10 minutes).

However, the timing for running the second time zone checking process may be shorter (such as 3 minutes or 5 minutes), and the interval until the second time zone checking process executes after the first time zone checking process changed to a second interval that is shorter than the first interval. This configuration enables shortening the time until the time zone change is confirmed and the displayed time is changed in the second time zone checking process.

The unique base station information of the base station 180 is not limited to a MAC address, and may be any information uniquely identifying a specific base station 180. In other words, the base station information may be set according to the base station specifications in the LPWA network or other communication standard.

When location information for the base station 180 is stored by the base station itself according to the base station 180 specifications, the positioning information server 130 may be omitted.

The process of checking the time zone at a regular interval is also not limited to 10 minutes, and may be set appropriately according to the capacity of the storage battery 24 or the allowable time lag until the displayed time is corrected when the time zone changes.

The time zone resetting function of the fifth embodiment can also be applied in the other embodiments. More specifically, the time zone resetting function can be applied to the electronic timepieces 1 to 1F in which the time zone is corrected automatically.

In the fifth embodiment, the time difference (time) is corrected in mode 1 when a change in time difference information is detected once, and the time difference (time) is corrected in mode 2 when a change in time difference information is multiple times, but the conditions for correcting the time difference may be change appropriately to the density of the base stations 180.

More specifically, in urban areas with a high population density, the number of base stations 180 per specific area is typically greater, the base station 180 density is higher, and the distance between base stations 180 is shorter. However, in rural areas where the population density is lower, for example, there are typically fewer base stations 180, the density is lower, and the distance between base stations 180 is greater. When the density of base stations 180 is high, there is a greater possibility of communicating with a base station 180 in a different time zone. As a result, if the time zone is decided by a single communication when travelling in a car with mode 1 selected, a change in time zones may be mistakenly determined if the time zone is set by a single communication.

Therefore, when the base station 180 density is high, the time zone may be corrected when the same time zone is continuously detected a first specific count or more (such as twice or more) even when mode 1 is set, and when mode 2 is set, the time zone may be corrected when the same time zone is continuously detected a second specific count or more that is greater than the first specific count (such as four times).

Density information indicating whether the base station 180 density is high or low may be previously set in each base station 180, and the control circuit 40 may acquire the density information when communicating with a base station 180, and change the conditions for changing the time difference correction in mode 1 and mode 2 according to the acquired density information. The base station 180 density information is also not limited to two levels, and may be set to three or more levels, and the time difference correction conditions in mode 1 and mode 2 may be set to three or more levels.

When executing the time zone checking process in the foregoing embodiments, power generation by the solar cell 22 is detected by the generating state detection circuit 43, and if power is not generated for a specific period, regular execution of the time zone checking process may be stopped or the frequency lowered.

This specific frequency may be set according to the capacity of the storage battery 24 or how the user uses the electronic timepiece 1. For example, if the user wears the electronic timepiece 1-1F on the wrist, power generation by the solar cell 22 can be detected. As a result, if the specific interval is set to 72 hours (three days) , and the user removes and leaves the timepiece in a drawer for two days over the weekend, power generation within 72 hours can be detected when the user wears the timepiece again on Monday. However, if power generation for 72 hours or more is not detected, the electronic timepiece 1-1F is most likely not being used. Therefore, whether or not the electronic timepiece 1-1F is being used can be determined based on whether or not power is generated, and there is no need to regularly execute the time zone checking process if the timepiece is not being used. Therefore, by stopping or reducing the frequency of the time zone checking process, the reception process will not run needlessly, and power consumption can be reduced.

Control of the regular time zone checking process when power is not generated for a specific time is also not limited to stages. For example, the control circuit 40 may execute the time zone checking process in three (first to third) power conservation modes that vary according to how long power is not generated.

In the first power conservation mode, the period during which power is not generated by the solar cell 22 starts when the time (such as 72 hours) set as the condition for entering the power conservation mode is reached, and ends four days after the first power conservation mode starts. When the first power conservation mode starts, the control circuit 40 stops the movement, and moves the second hand to a position (such as the 45 second position) for indicating the first power conservation mode. The control circuit 40 also continues keeping the internal time by the timekeeping means 51, and the regular time zone checking process executes as usual, such as at a 10 minute interval.

The second power conservation mode starts when the first power conservation mode ends (after four days in the first power conservation mode), and ends 25 days after the second power conservation mode starts (30 days after the first power conservation mode started). When the second power conservation mode starts, the control circuit 40 keeps the movement stopped, and moves the second hand to a position (such as the 30 second position) for indicating the second power conservation mode. The control circuit 40 also continues keeping the internal time by the timekeeping means 51, and the regular time zone checking process executes at a greater interval, such as a 24 hour interval (a frequency of once a day).

The third power conservation mode starts when the second power conservation mode ends (30 days after the first power conservation mode started). When the third power conservation mode starts, the control circuit 40 keeps the movement stopped, and moves the second hand to a position (such as the 15 second position) for indicating the third power conservation mode. The control circuit 40 also continues keeping the internal time by the timekeeping means 51, but does not execute the time zone checking process.

Note because that the internal time correction process shown in FIG. 8 is a daily (once/day) process, and runs to improve the accuracy of the time, the internal time correction process preferably executes in the first to third power conservation modes.

If power generation by the solar cell 22 is detected in any of the power conservation modes, the control circuit 40 moves the hands 12 (second hand, minute hand, hour hand) to indicate the current time if the timekeeping means 51 continues keeping the internal time. When resuming operation from the second or third power conservation modes, the regular time zone checking process executes at 10 minute interval, and if the time zone has changed, the current time indicated by the hands 12 is corrected.

If the storage battery 24 has dropped and the control circuit 40 has stopped when power generation by the solar cell 22 is detected, the internal time kept by the timekeeping means 51 will not be correct. As a result, the control circuit 40 resets the internal time counter of the timekeeping means 51, executes the time zone checking process and internal time correction process again, and displays the current time based on the acquired information.

Note that transition to the first to third power conservation modes may be controlled by detecting the storage battery 24 voltage, or controlled based on the result of detecting power generation by the solar cell 22 and the detected storage battery 24 voltage. For example, if in the first and second power conservation modes the voltage of the storage battery 24 is regularly detected (such as once a day), and the storage battery 24 voltage is particularly low, the third power conservation mode may be entered immediately.

The communication standard used for communication between the base station 180 and communication circuit 30 is not limited to a LPWA network standard, and any standard enabling long distance communication with low power consumption may be used.

Furthermore, the foregoing embodiments describe electronic timepieces 1 to 1F having a second hand, minute hand, and hour hand as examples of an electronic device, but the invention may be applied to pocket watches, table clocks, wall clocks, or other type of timepiece, but is particularly useful for mobile (wearable) electronic timepieces.

An electronic device according to the disclosure is also not limited to timepieces, and may be an electronic device such as a mobile phone, PDA (Personal Digital Assistants), mobile measuring device, or mobile GPS (Global Positioning System) device, or other type of mobile electronic device, or a standard oscillator, notebook computer, or other electronic device. More particularly, because the invention enables acquiring time zone-related information through a network, correcting the current time at the current location, and reducing power consumption, the invention is particularly suitable for mobile, compact electronic devices with an internal power source having an internal power source (battery) that supplies operating power and requires long-term usability.

The invention being thus described, it will be obvious that it may be varied in many ways. Such variations are not to be regarded as a departure from the spirit and scope of the invention, and all such modifications that would be obvious to one skilled in the art are intended to be included within the scope of the following claims.

The entire disclosure of Japanese Patent Application No. 2017-215625 filed Nov. 8, 2017 is expressly incorporated by reference herein.

What is claimed is:

1. An electronic device comprising:

a time display unit configured to display time;

a communicator configured to wirelessly connect to a base station; and a controller configured to execute:

a base station information acquisition process to acquire unique base station information from the connected base station, an acquired information evaluation process to determine whether to acquire time zone-related information based on the base station information, a time zone information acquisition process to acquire time zone-related information based on the base station information when the acquired information evaluation process determines to acquire time zone-related information, and a time correction process to correct a displayed time based on the acquired time zone-related information, wherein the controller, in the time zone information acquisition process, it configured to execute the time correction process when the same time difference information is acquired multiple times consecutively.

2. The electronic device described in claim 1, further comprising:

storage configured to store previously acquired base station information; and when the base station information acquired through the communicator, and the previously acquired base station information stored in the storage, match in the acquired information evaluation process, the controller is configured to determine in the acquired information evaluation process to not acquire time zone-related information.

3. The electronic device described in claim 1, further comprising:

storage configured to relationally store previously acquired base station information and time difference information; and when the base station information acquired in the base station information acquisition process is included in previously acquired base station information stored in the storage, the controller is configured to:

determine, in the acquired information evaluation process, to not acquire time zone-related information, and adjust, in the time correction process, the displayed time using related time difference information stored in the storage.

4. The electronic device described in claim 1, further comprising:

time difference information storage configured to relationally store location information and time difference information; and the controller is configured to:

execute, as the time zone information acquisition process:

a location information acquisition process to output the base station information through the base station to a network, and acquire location information of the base station from a location information server connected to the network and storing location information relating the base station information to the base station, and a time difference information acquisition process to acquire from the time difference information storage time difference information corresponding to the acquired location information of the base station; and correct, as the time correction process:

the displayed time using the time difference information acquired in the time difference information acquisition process.

5. The electronic device described in claim 1, wherein:

the controller is configured to:

execute, as the time zone information acquisition process:

a location information acquisition process to output the base station information through the base station to a network, and acquire location information of the base station from a location information server on the network and storing location information relating the base station information to the base station, and a time difference information acquisition process outputting the base station location information through the base station to the network, and acquiring time difference information of the location information from a time zone server connected to the network and storing the location information and time difference information corresponding to the location information; and correct, as the time correction process:

the displayed time using the time difference information acquired in the time difference information acquisition process.

6. The electronic device described in claim 1, wherein:

the controller is configured to:

execute, as the time zone information acquisition process:

a time difference information acquisition process outputting the base station location information through the base station to the network, and acquiring time difference information of the base station from a base station time difference information server connected to the network and storing the base station information and time difference information corresponding to the base station information; and correct, as the time correction process:

the displayed time using the time difference information acquired in the time difference information acquisition process.

7. The electronic device described in claim 1, wherein:

the controller is configured to execute the base station information acquisition process regularly at a first time interval, and if time difference information different from the currently set time difference information is acquired in the time zone information acquisition process, the controller is configured to execute the base station information acquisition process at a second time interval that is shorter than the first time interval.

8. The electronic device described in claim 1, further comprising:

an operating unit; and the controller configured to:

select a condition for correcting the time difference according to operation of the operating unit, and execute the time correction process based on the selected condition.

9. The electronic device described in claim 1, further comprising:

an operating unit; and the controller configured to reset the previously set time zone and correct the displayed time when a previously set operation of the operating unit is executed after the displayed time is corrected based on time zone-related information acquired in the time zone information acquisition process.

10. The electronic device described in claim 1, further comprising:

a generator configured to generate power; and a storage battery that is charged by the generator.

11. The electronic device described in claim 10, wherein:

the controller is configured to regularly execute the base station information acquisition process, and when power is not generated by the generator for a specific time, the controller is configured to stop or reduce an execution frequency of the regular base station information acquisition process.

12. The electronic device described in claim 1, wherein:

the controller is configured to regularly execute the base station information acquisition process.

13. The electronic device described in claim 1, wherein:
the communicator is configured to connect to the base station by a Low-Power Wide-Area Network standard.

14. A time correction system comprising:
multiple base stations connected through a network,
a server operatively associated with the network, and relationally storing:
unique base station information related to the base stations, and
information related to a time zone of each base station, and
an electronic device configured to wirelessly connect to the base stations, wherein:
the electronic device has:
a time display unit configured to display time;
a communicator configured to wirelessly connect to the base stations; and
a controller configured to execute:
a base station information acquisition process to acquire unique base station information from the connected base station,
an acquired information evaluation process to determine whether to acquire time zone-related information based on the base station information,
a time zone information acquisition process to acquire time zone-related information based on the base station information when the acquired information evaluation process determines to acquire time zone-related information, and
a time correction process to correct a displayed time based on the acquired time zone-related information; and
the server is configured to output, when the base station information is received from the electronic device, information related to the time zone corresponding to the base station information to the electronic device,
wherein the controller, in the time zone information acquisition process, is configured to execute the time correction process when the same time difference information is acquired multiple times consecutively.

15. A method of correcting a time displayed on a time display of an electronic device based on acquired time zone-related information, the method comprising:
wirelessly connecting the electronic device to one of a plurality of base stations;
acquiring unique base station information from the connected one base station;
determining whether to acquire time zone-related information based on the base station information;
acquiring time zone-related information based on the base station information when it is determined to acquire time zone-related information; and
correcting the time displayed based on the acquired time zone-related information,
wherein, in the acquiring of the time zone information, the correcting of the time is performed when the same time difference information is acquired multiple times consecutively.

16. The method of claim 15, further comprising:
storing previously acquired base station information for the connected one base station; and
determining not to acquire the time zone-related information when the acquired base station information for the connected one base stations matches the previously acquired base station information.

17. The method of claim 15, further comprising:
manually selecting a condition on the electronic device for acquiring the time zone-related information and correcting the time displayed.

18. The method of claim 15, further comprising:
periodically charging a storage battery included in the electronic device with a generator included in the electronic device; and
when power is not generated by the generator for a specific time period, stopping or reducing an execution frequency of acquiring the unique base station information.

19. The method of claim 15, further comprising:
using a Low-Power Wide-Area Network standard to wirelessly connect the electronic device to the connected one base station.

* * * * *